US008552815B2

(12) United States Patent
Fujii et al.

(10) Patent No.: US 8,552,815 B2
(45) Date of Patent: Oct. 8, 2013

(54) HIGH-FREQUENCY LINE STRUCTURE FOR IMPEDANCE MATCHING A MICROSTRIP LINE TO A RESIN SUBSTRATE AND METHOD OF MAKING

(75) Inventors: Tomoharu Fujii, Nagano (JP); Yukari Chino, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 309 days.

(21) Appl. No.: 12/787,451

(22) Filed: May 26, 2010

(65) Prior Publication Data

US 2010/0308941 A1 Dec. 9, 2010

(30) Foreign Application Priority Data

Jun. 5, 2009 (JP) ..... 2009-136088

(51) Int. Cl.
*H01P 5/02* (2006.01)

(52) U.S. Cl.
USPC ..... 333/33; 333/248

(58) Field of Classification Search
USPC ..... 333/238, 246, 33, 208, 212, 248
See application file for complete search history.

(56) References Cited

U.S. PATENT DOCUMENTS 4,547,901 A * 10/1985 Shibata et al. ..... 455/300
5,731,751 A * 3/1998 Vangala ..... 333/212
5,926,079 A * 7/1999 Heine et al. ..... 333/208
6,236,287 B1 * 5/2001 Quan et al. ..... 333/33
6,400,234 B1 * 6/2002 Ohhashi et al. ..... 333/33
6,927,653 B2 * 8/2005 Uchimura et al. ..... 333/208
2005/0146390 A1 * 7/2005 Baek ..... 333/33

FOREIGN PATENT DOCUMENTS

JP 2002-280748 9/2002
JP 2005-051330 2/2005
JP 2006-279481 10/2006

OTHER PUBLICATIONS

Office Action dated May 7, 2013 issued with respect to the basic Japanese Patent Application No. 2009-136088.

* cited by examiner

*Primary Examiner* — Benny Lee
(74) *Attorney, Agent, or Firm* — IPUSA, PLLC

(57) ABSTRACT

A high-frequency line structure includes a multi-layered resin substrate in which insulating layers of a resin are laminated. A high-frequency-signal input part is arranged on the resin substrate to input a high-frequency signal and supply the high-frequency signal to the resin substrate. A high-frequency-signal output part is arranged in the resin substrate to receive the high-frequency signal from the input part and output the received high-frequency signal. A first metal layer is arranged to encircle the input and output pads and electrically insulated from the input and output parts. A second metal layer is arranged on the resin substrate. A plurality of penetration vias are arranged in the resin substrate to encircle the input part and the output part, and each penetration via being connected to the first and second metal layers.

6 Claims, 20 Drawing Sheets

HIGH-FREQUENCY LINE STRUCTURE FOR IMPEDANCE MATCHING A MICROSTRIP LINE TO A RESIN SUBSTRATE AND METHOD OF MAKING

CROSS-REFERENCE TO RELATED APPLICATION

This application is based upon and claims the benefit of priority of Japanese patent application No. 2009-136088 filed on Jun. 5, 2009, the entire contents of which are incorporated herein by reference in their entirety.

BACKGROUND OF THE INVENTION

1. Field of the Invention

This invention relates to a high-frequency line structure on a resin substrate and a method of manufacturing the same, the high-frequency line structure being adapted for reducing the propagation loss of a high frequency signal.

2. Description of the Related Art

In wiring substrates for use in mobile communications devices which use radio signals, such as microwaves or millimeter waves, whose radio wavelengths range from approximately one meter down to approximately one millimeter, a high-frequency line structure for propagating a radio signal is provided (for example, see FIG. 1). In the following, a radio signal that is propagated on a high-frequency line structure will be called a high frequency signal.

FIG. 1 is a perspective view illustrating the composition of a high-frequency line structure 200 on a resin substrate according to the related art. As illustrated in FIG. 1, the high-frequency line structure 200 according to the related art is a microstrip type high-frequency transmission line. The high-frequency line structure 200 includes a dielectric layer 201, a signal wiring 202 disposed on a top surface 201A of the dielectric layer 201 to propagate a high frequency signal, and a ground layer 203 disposed to cover a bottom surface 201B of the dielectric layer 201. For example, Japanese Laid-Open patent publication No. 2002-280748 discloses a high-frequency line structure of this type.

The high-frequency line structure 200 according to the related art has a problem that the propagation loss of the high frequency signal will be increased if the length of the signal wiring 202 is increased.

Electromagnetic waves or magnetic fields which are the components of the high frequency signal are leaked out from the signal wiring 202 into the air, and the high-frequency line structure 200 according to the related art has a problem that the propagation loss of the high frequency signal will be further increased.

SUMMARY OF THE INVENTION

In one aspect of the invention, the present disclosure provides a high-frequency line structure on a resin substrate and a method of manufacturing the same which are adapted to reduce the propagation loss of a high frequency signal.

In an embodiment of the invention which solves or reduces one or more of the above-described problems, the present disclosure provides a high-frequency line structure including: a multi-layered resin substrate in which a plurality of insulating layers of a resin are laminated; a high-frequency-signal input part including an input pad arranged on a first surface of the resin substrate, a supply pad arranged in the resin substrate to face the input pad, and a first via arranged in a portion of the resin substrate located between the input pad and the supply pad and connected to the input pad and the supply pad; a high-frequency-signal output part including a output pad arranged on the first surface of the resin substrate, a reception pad arranged in the resin substrate to face the output pad, and a second via arranged in a portion of the resin substrate located between the output pad and the reception pad, and connected to the output pad and the reception pad; a first metal layer arranged on the first surface of the resin substrate to encircle the input pad and the output pad and electrically insulated from the high-frequency-signal input part and the high-frequency-signal output part; a second metal layer arranged to cover a second surface of the resin substrate opposite to the first surface of the resin substrate; and a plurality of penetration vias arranged in the resin substrate to encircle the high-frequency-signal input part and the high-frequency-signal output part, and each penetration via connected to the first and second metal layers.

Other objects, features and advantages of the invention will be apparent from the following detailed description when read in conjunction with the accompanying drawings.

DETAILED DESCRIPTION OF PREFERRED EMBODIMENTS

A description will now be given of embodiments of the invention with reference to the accompanying drawings.

Figure 1:
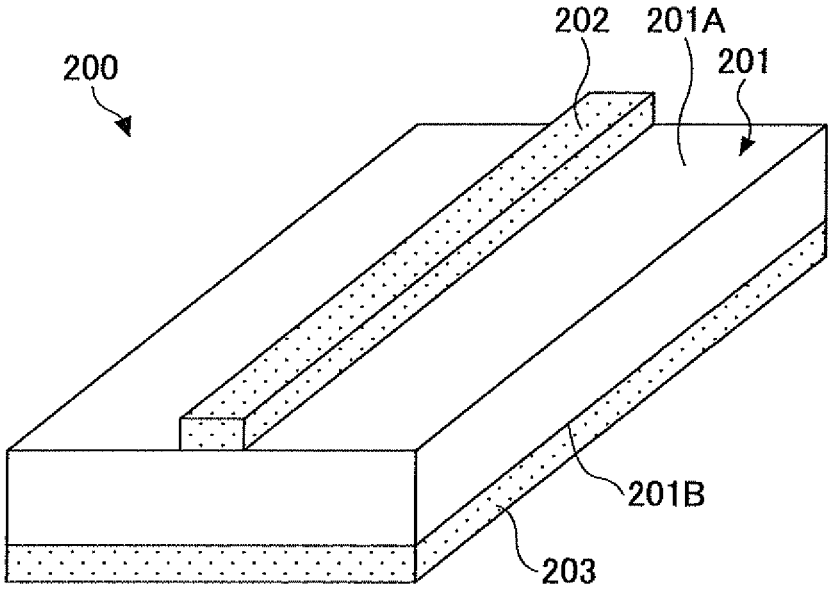
FIG.1 RELATED ART
FIG. 1 is a perspective view illustrating the composition of a high-frequency line structure on a resin substrate according to the related art.
Figure 2:
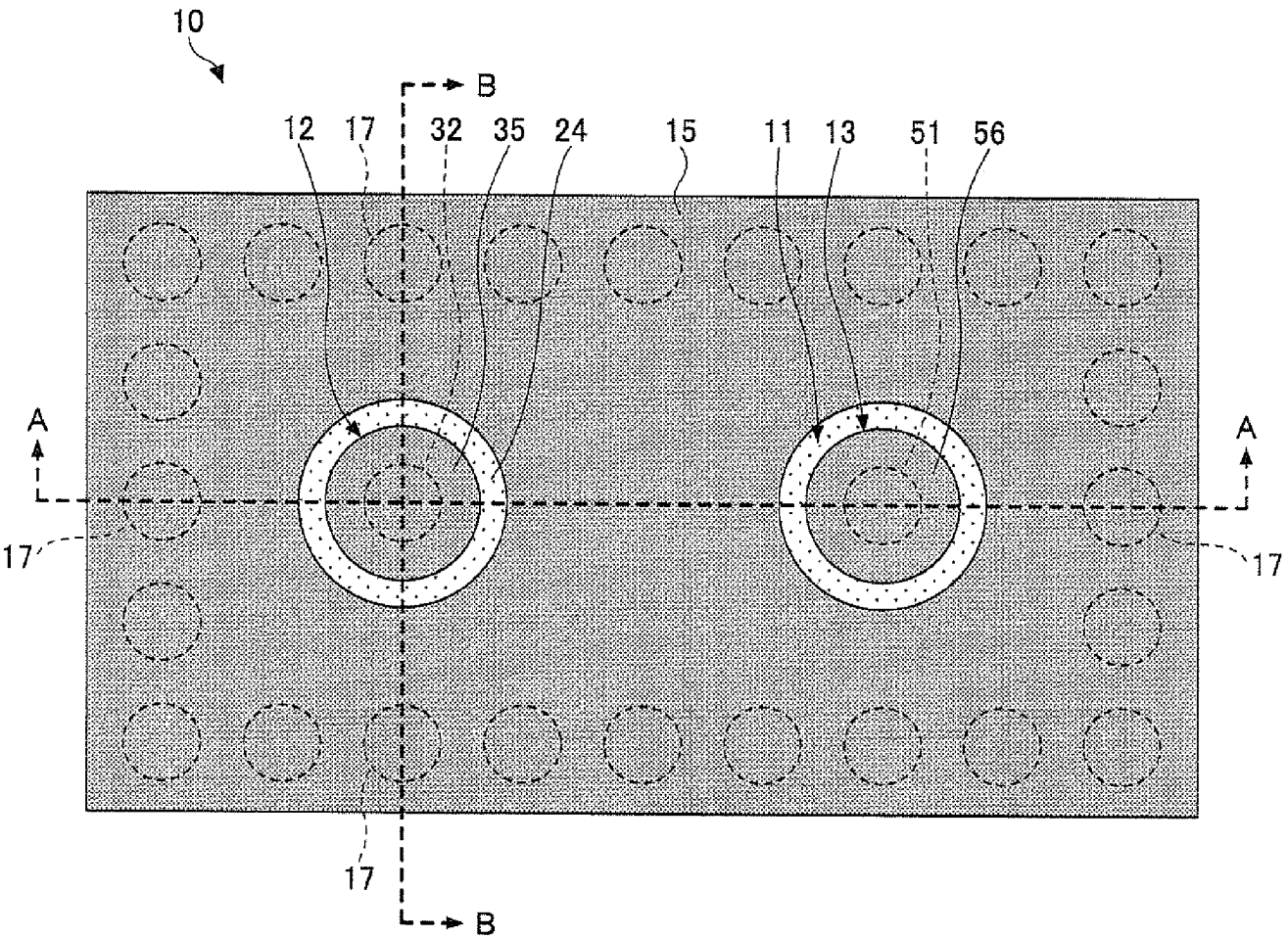
FIG. 2 is a plan view of a high-frequency line structure on a resin substrate of an embodiment of the invention.
Figure 3:
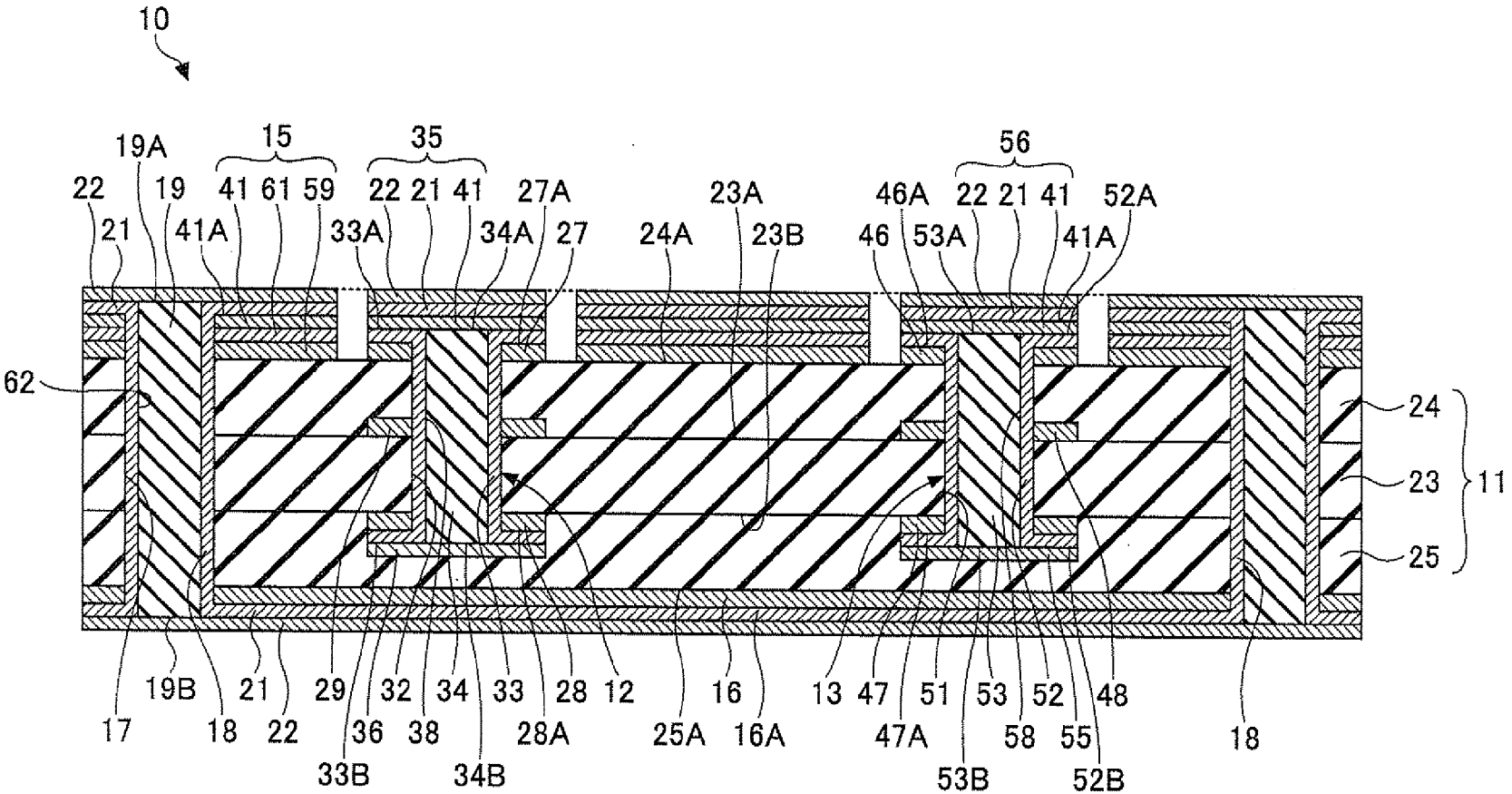
FIG. 3 is a cross-sectional view of the high-frequency line structure of the present embodiment taken along an A-A line indicated in FIG. 2.
Figure 4:
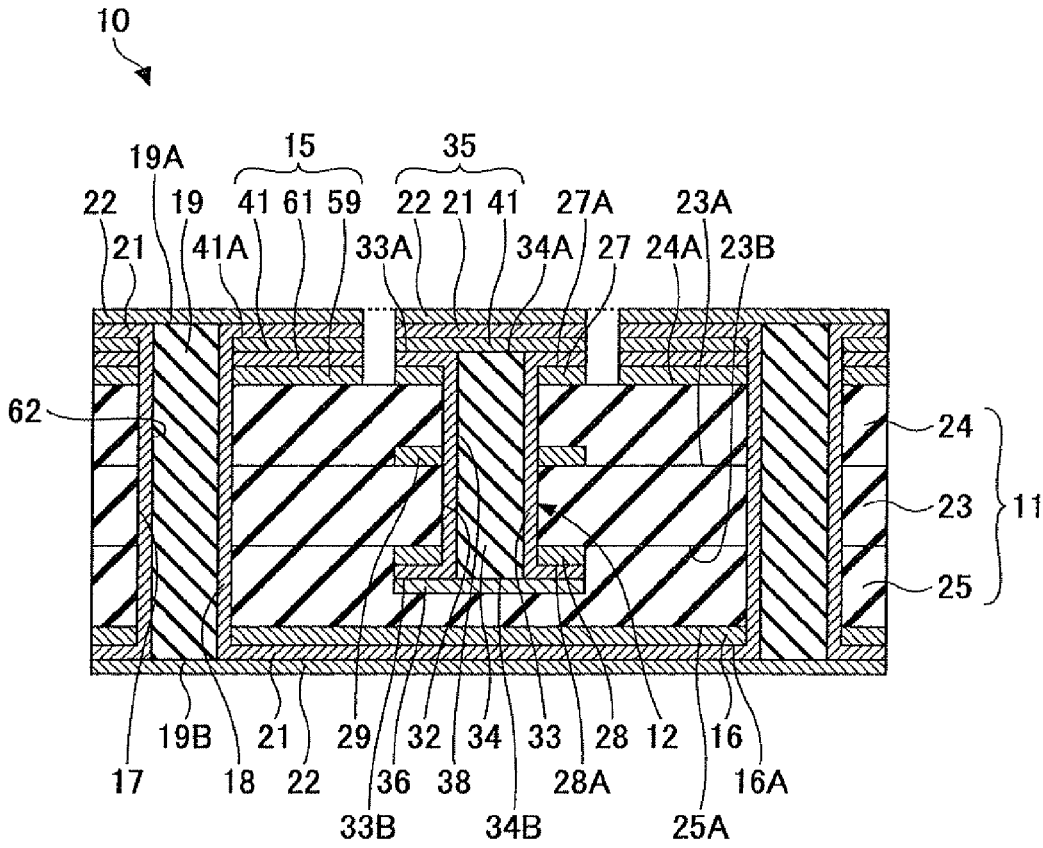
FIG. 4 is a cross-sectional view of the high-frequency line structure of the present embodiment taken along a B-B line indicated in FIG. 2.

FIG. 2 is a plan view of a high-frequency line structure on a resin substrate of an embodiment of the invention. FIG. 3 is a cross-sectional view of the high-frequency line structure of this embodiment taken along the A-A line indicated in FIG. 2. FIG. 4 is a cross-sectional view of the high-frequency line structure of this embodiment taken along the B-B line indicated in FIG. 2.

As illustrated in FIGS. 2 to 4, the high-frequency line structure 10 of this embodiment includes a multi-layered resin substrate 11, a high-frequency-signal input part 12, a high-frequency-signal output part 13 (FIGS. 2, 3), a first metal layer 15 (FIGS. 2 to 4), a second metal layer 16 (FIGS. 3, 4), a plurality of penetration holes 17 (each of which is a third penetration hole), a plurality of penetration vias 18 (FIGS. 3, 4), and metal layers 21 and 22 (FIGS. 3, 4).

In the high-frequency line structure 10 having the composition described above, a Zo matching circuit is constituted by the high-frequency-signal input part 12, the high-frequency-signal output part 13, and the plurality of penetration vias 18 (which are arranged in a direction perpendicular to a straight line connecting the high-frequency-signal input part 12 and the high-frequency-signal output part 13), and a waveguide is formed by the portion which is surrounded by the first metal layer 15, the second metal layer 16, and the plurality of penetration vias 18.

As illustrated in FIGS. 3 and 4, the multi-layered resin substrate 11 is constituted by a plurality of insulating layers 23-25 (FIGS. 3, 4) which are made of a resin and laminated together. The insulating layer 23 is disposed between the insulating layer 24 and the insulating layer 25. The insulating layer 24 is formed on a top surface 23A of the insulating layer 23. The insulating layer 25 is formed on a bottom surface 23B of the insulating layer 23.

For example, a cured organic resin layer may be used as a material of the insulating layers 23-25. In this case, a prepreg resin in which a resin (for example, epoxy resin) is impregnated in a glass cloth may be used as the material, of the insulating layers 23-25. In this case, the insulating layer 23 may have a thickness of 260 micrometers, for example. Each of the insulating layers 24 and 25 may have a thickness of 300 micrometers, for example.

As illustrated in FIGS. 3 and 4, the high-frequency-signal input part 12 includes a pad 27 (which is a first pad), a pad 28 (which is a second pad), a conductor 29 (which is a first conductor), a penetration hole 32 (which is a first penetration hole), a via 33 (which is a first via), an insulating resin 34, an input pad 35, and a supply pad 36.

The pad 27 is disposed on a surface 24A (FIGS. 3, 4) (which is a first surface of the multi-layered resin substrate 11) of the insulating layer 24 which surface is located on the side opposite to a surface of the insulating layer 24 in contact with the insulating layer 23. The pad 27 may be formed to have a circular cross-section, for example. The pad 27 may have a thickness of 20 micrometers, for example. The pad 27 may have a diameter of 600 micrometers, for example. For example, copper (Cu) may be used as a material of the pad 27.

The pad 28 is disposed on the surface 23B of the insulating layer 23. The pad 28 is arranged to face the pad 27 through the insulating layers 23 and 24. The pad 28 serves to match the impedance of the MLS (microstrip line) and the waveguide. The pad 28 may be formed to have a circular cross-section, for example. The pad 28 may have a diameter of 600 micrometers, for example. The pad 28 may have a thickness of 20 micrometers, for example. For example, copper (Cu) may be used as a material of the pad 28.

The conductor 29 is disposed on the surface 23A of the insulating layer 23 in the portion located between the pad 27 and the pad 28. The conductor 29 is arranged so that the conductor 29 faces the pad 27 via the insulating layer 24 and faces the pad 28 via the insulating layer 23. The conductor 29 is a conductor for matching the impedance of the MSL and the waveguide. The conductor 29 may be formed to have a circular cross-section, for example. The conductor 29 may have a diameter of 600 micrometers, for example. The conductor 29 may have a thickness of 20 micrometers, for example. For example, copper (Cu) may be used as a material of the pad 29.

The penetration hole 32 is formed to penetrate the insulating layers 23 and 24, the pad 27, the pad 28, and the conductor 29. The portions of the pad 27, the pad 28 and the conductor 29 are exposed to the side of the penetration hole 32. The penetration hole 32 may have a diameter of 250 micrometers, for example.

The via 33 is formed to cover the side of the penetration hole 32, the top surface 27A (FIGS. 3, 4) of the pad 27, and the bottom surface 28A (FIGS. 3, 4) of the pad 28. Thereby, the via 33 is connected to the pad 27, the pad 28, and the conductor 29 in the portion exposed to the penetration hole 32. Namely, the via 33 is electrically connected to each of the pad 27, the pad 28, and the conductor 29.

The via 33 is formed to have a penetration hole 38 (FIGS. 3, 4) which penetrates the centerline of the via 33. The via 33 may have a thickness of 15 micrometers, for example. The penetration hole 38 may have a diameter of 220 micrometers, for example. For example, copper (Cu) may be used as a material of the via 33.

As illustrated in FIGS. 3 and 4, the penetration hole 38 is filled with the insulating resin 34. An end face 34A of the insulating resin 34 is formed so that the end face 34A is flush with an end face 33A of the via 33. An end face 34B of the insulating resin 34 is formed so that the end face 34B is flush with an end face 33B of the via 33. For example, an epoxy resin may be used as a material of the insulating resin 34.

As illustrated in FIGS. 3 and 4, the input pad 35 is constituted by the metal layers 21, 22 and a metal layer 41 which are laminated together. The metal layer 41 is formed to cover the end face 33A of the via 33 and the end face 34A of the insulating resin 34. Thereby, the input pad 35 is electrically connected to the via 33. In FIGS. 3 and 4 (and FIGS. 12-19), reference numeral 41A denotes a top surface of the metal layer 41.

The metal layer 21 is formed to cover the top surface of the metal layer 41. The metal layer 22 is formed to cover the top surface of the metal layer 21. For example, copper (Cu) may be used as a material of the metal layers 21, 22, and 41. When using a Cu layer as the metal layer 21, the metal layer 21 may have a thickness of 15 micrometers, for example. When using a Cu layer as the metal layer 22, the metal layer 22 may have a thickness of 10 micrometers, for example. When using a Cu layer as the metal layer 41, the metal layer 41 may have a thickness of 10 micrometers, for example. In other words, the input pad 35 may have a thickness of 35 micrometers, for example. The input pad 35 may have a diameter of 600 micrometers, for example.

The input pad 35 is a pad at which a high frequency signal externally supplied to the high-frequency line structure 10 is input. When the high frequency signal is input, the input pad 35 propagates the input high frequency signal to the via 33.

The supply pad 36 is formed to cover the end face 33B of the via 33 and the end face 34B of the insulating resin 34. Thereby, the supply pad 36 is electrically connected to the via 33.

The supply pad 36 is a pad for supplying the high frequency signal propagated from the via 33 to the multi-layered resin substrate 11. For example, copper (Cu) may be used as a material of the supply pad 36. The supply pad 36 may have a diameter of 600 micrometers, for example. The supply pad 36 may have a thickness of 10 micrometers, for example.

As illustrated in FIG. 3, the high-frequency-signal output part 13 includes a pad 46 (which is a third pad), a pad 47 (which is a fourth pad), a conductor 48 (which is a second conductor), a penetration hole 51 (FIGS. 2, 3) (which is a second penetration hole), a via 52 (which is a second via), an insulating resin 53, a reception pad 55, and an output pad 56 (FIGS. 2, 3). In FIG. 3 (and FIGS. 8-19), reference numeral 46A denotes a top surface of the pad 46, and reference numeral 47A denotes a bottom surface of the pad 47.

The pad 46 is disposed on the surface 24A of the insulating layer 24 which surface is located on the side opposite to the surface of the insulating layer 24 in contact with the insulating layer 23. The pad 46 is disposed in the position which is apart from the pad 27. The pad 46 may be formed to have a circular cross-section, for example. The pad 46 may have a diameter of 600 micrometers, for example. The pad 46 may have a thickness of 20 micrometers, for example. For example, copper (Cu) may be used as a material of the pad 46.

The pad 47 is disposed on the surface 23B of the insulating layer 23. The pad 47 is arranged to face the pad 46 through the insulating layers 23 and 24. The pad 47 serves to match the impedance of the MSL (microstrip line) and the waveguide. The pad 47 may be formed to have a circular cross-section, for example. The pad 47 may have a diameter of 600 micrometers, for example. The pad 47 may have a thickness of 20 micrometers, for example. For example, copper (Cu) may be used as a material of the pad 47.

The conductor 48 is disposed on the surface 23A of the insulating layer 23 in the portion located between the pad 46 and the pad 47. The conductor 48 is arranged to face the pad 46 through the insulating layer 24 and arranged to face the pad 47 through the insulating layer 23. The conductor 48 is a conductor for matching the impedance of the MSL (microstrip line) and the waveguide. The conductor 48 may be formed to have a circular cross-section, for example. The conductor 48 may have a diameter of 600 micrometers, for example. For example, copper (Cu) may be used as a material of the conductor 48.

The penetration hole 51 is formed to penetrate the pad 46, the pad 47, the conductor 48, and the insulating layers 23 and 24 in the portion located between the pad 46 and the pad 47. The portions of the pad 46, the pad 47, and the conductors 48 are exposed to the side of the penetration hole 51. The penetration hole 51 may have a diameter of 250 micrometers, for example.

The via 52 is formed to cover the side of the penetration hole 51, the top surface 46A (FIG. 3) of the pad 46, and the bottom surface 47A (FIG. 31 of the pad 47. Thereby, the via 52 is connected to each of the pad 46, the pad 47, and the conductor 48 in the portions exposed to the penetration hole 51. Namely, the via 52 is electrically connected to each of the pad 46, the pad 47, and the conductor 48.

The via 52 is formed to have a penetration hole 58 (FIG. 31 which penetrates the centerline of the via 52. The via 52 may have a thickness of 15 micrometers, for example. The penetration hole 58 may have a diameter of 220 micrometers, for example. For example, copper (CU) may be used as a material of the via 52.

The penetration hole 58 is filled with the insulating resin 53. An end face 53A (FIG. 3) of the insulating resin 53 is formed so that the end face 53A is flush with an end face 52A (FIG. 3) of the via 52. An end face 53B of the insulating resin 53 is formed so that the end face 53B (FIG. 3) is flush with an end face 52B (FIG. 3) of the via 52. For example, an epoxy resin may be used as a material of the insulating resin 53.

The reception pad 55 is formed to cover the end face 52B of the via 52 and the end face 53B of the insulating resin 53. Thereby, the reception pad 55 is electrically connected to the via 52. The reception pad 55 is a pad for receiving the high frequency signal propagated from the multi-layered resin substrate 11 and for propagating the received high frequency signal to the via 52. For example, copper (Cu) may be used as a material of the reception pad 55. The reception pad 55 may have a diameter of 600 micrometers, for example. The reception pad 55 may have a thickness of 10 micrometers, for example.

The output pad 56 is formed to cover the end face 52A of the via 52 and the end face 53A of the insulating resin 53. The output pad 56 is constituted by the metal layers 21, 22, and 41 which are laminated together. Namely, the output pad 56 is formed to have the composition that is the same as that of the input pad 35. The output pad 56 is a pad for outputting the high frequency signal propagated from the via 52 to the outside of the high-frequency line structure 10.

The first metal layer 15 is disposed on the surface 24A of the insulating layer 24 to encircle the pads 27 and 46, the input pad 35, and the output pad 56. A slot is formed between the first metal layer 15 and the input pad 35, and a slot is formed between the first metal layer 15 and the output pad 56. Thereby, the first metal layer 15 is electrically insulated from both the input pad 35 and the output pad 56.

As illustrated in FIGS. 3 and 4, the first metal layer 15 is a grounding layer, and the metal layer 59 (FIGS. 3, 4), the metal layer 61 (FIGS. 3, 4), and the metal layer 41 (FIGS. 3, 4) are laminated one by one and the metal layers 41, 59 and 61 form the first metal layer 15. The metal layer 59 is disposed on the surface 24A of the insulating layer 24. For example, copper (Cu) may be used as a material of the metal layer 59. When a Cu layer is used as the metal layer 59, the metal layer 59 may have a thickness of 20 micrometers, for example.

The metal layer 61 is disposed on the top surface of the metal layer 59. For example, copper (Cu) may be used as a material of the metal layer 61. When a Cu layer is used as the metal layer 61, the metal layer 61 may have a thickness of 15 micrometers, for example.

The first metal layer 15 in the above-described composition is provided for preventing the high frequency signal (which is supplied from the supply pad 36 to the multi-layered resin substrate 11) from leaking out from the top surface of the multi-layered resin substrate 11. The first metal layer 15 has a shielding function to block off the incoming electromagnetic waves from the outside of the high-frequency line structure 10.

The second metal layer 16 is formed to cover the surface 25A (FIGS. 3, 4) of the insulating layer 25 (the second surface of the multi-layered resin substrate 11) which surface is located on the side opposite to the surface of the insulating layer 25 in contact with the insulating layer 23. The second metal layer 16 is provided for preventing the high frequency signal (which is supplied from the supply pad 36 to the multi-layered resin substrate 11) from leaking out from the bottom surface of the multi-layered resin substrate 11. The second metal layer 16 has a shielding function to block off the incoming electromagnetic waves from the outside of the high-frequency line structure 10. In FIGS. 3 and 4 (and FIGS. 14-19), reference numeral 16A denotes a bottom surface of the second metal layer 16.

For example, copper (Cu) may be used as a material of the second metal layer 16. When a Cu layer is used as the second metal layer 16, the second metal layer 16 may have a thickness of 20 micrometers, for example.

The plurality of penetration holes 17 are formed to penetrate the first metal layer 15, the second metal layer 16, and the multi-layered resin substrate 11 in the portions located outside the area where the high frequency signal input part 12 is formed and located outside the area where the high-frequency-signal output part 13 is formed. In the plurality of penetration holes 17, the first and second metal layers 15 and 16 are partly exposed. The plurality of penetration holes 17 are arranged to encircle the high frequency signal input part 12 and the high-frequency-signal output part 13.

One of the plurality of penetration vias 18 is formed on the side of each of the plurality of penetration holes 17. Each penetration via 18 is connected to both the first and second metal layers 15 and 16 in the portions exposed in the penetration hole 17. Thereby, each penetration via 18 is electrically connected to both the first metal layer 15 and the second metal layer 16. In other words, the first metal layer 15, the second metal layer 16, and each penetration via 18 are set at the same potential.

The plurality of penetration vias 18 are provided for preventing the high frequency signal (which is supplied from the supply pad 36 to the multi-layered resin substrate 11) from leaking out from the side of the multi-layered resin substrate 11. The plurality of penetration vias 18 have a shielding function to block off the incoming electromagnetic waves from the outside of the high-frequency line structure 10.

In the present embodiment, the first metal layer 15 is provided on the top surface of the multi-layered resin substrate 11, the second metal layer 16 is provided on the bottom surface of the multi-layered resin substrate 11, and the plurality of penetration vias 18 are arranged to penetrate the first and second metal layers 15 and 16 and the multi-layered resin substrate 11 and arranged to encircle the high frequency signal input part 12 and the high-frequency-signal output part 13. At this time, it is preferred to set each of the first metal layer 15, the second metal layer 16, and the plurality of penetration vias 18 to the ground potential. This makes it possible to prevent the leaking out of the high frequency signal (supplied from the supply pad 36 to the multi-layered resin substrate 11) to the outside of the high-frequency line structure 10, and makes it possible to block off the incoming electromagnetic waves from the outside of the high-frequency line structure 10. Therefore, it is possible for the present embodiment to effectively reduce the propagation loss of a high frequency signal being propagated between the high-frequency-signal input part 12 and the high-frequency-signal output part 13 through the multi-layered resin substrate 11.

Each penetration via 18 has a penetration hole 62 (FIGS. 3, 4) which penetrates the centerline of the penetration via 18. Each penetration via 18 may have a thickness of 15 micrometers, for example. In this case, the penetration hole 62 may have a diameter of 320 micrometers, for example.

As illustrated in FIGS. 3 and 4, the penetration hole 62 is filled with the insulating resin 19. An end face 19A of the insulating resin 19 is formed so that the end face 19A is flush with the top surface of the metal layer 21 which constitutes a part of the first metal layer 15. An end face 19B of the insulating resin 19 is formed so that the end face 19B is flush with the bottom surface of the metal layer 21 formed in the second metal layer 16. For example, an epoxy resin may be used as a material of the insulating resin 19.

The metal layer 21 is formed to cover the first metal layer 15, the top surface 41A of the metal layer 41 which constitutes a part of the input pad 35 and the output pad 56, and the bottom surface of the second metal layer 16.

The metal layer 22 is formed to cover the first metal layer 15, the top surface of the metal layer 21 which constitutes a part of the input pad 35 and the output pad 56, the end faces 19A and 19B of the insulating resin layer 19, and the bottom surface of the metal layer 21 formed in the second metal layer 16. The metal layer 22 formed on the end faces 19A and 19B of the insulating resin layer 19 serves as a lid for sealing the insulating resin 19 in the penetration hole 62.

In the high-frequency line structure of this embodiment, the high-frequency-signal input part 12 is arranged in the multi-layered resin substrate 11 (in which the insulating layers 23-25 are laminated together) to supply the input high frequency signal to the multi-layered resin substrate 11. The high-frequency-signal output part 13 is arranged in the multi-layered resin substrate 11 in the position apart from the high-frequency-signal input part 12 to receive the high frequency signal (which is supplied from the high-frequency-signal input part 12 to the multi-layered resin substrate 11) and output the received high frequency signal. The first metal layer 15 is arranged on the top surface of the multi-layered resin substrate 11 so that the first metal layer 15 is electrically insulated from both the high frequency signal input part 12 and the high-frequency-signal output part 13. The second metal layer 16 is arranged to cover the bottom surface of the multi-layered resin substrate 11. The plurality of penetration vias 18 are arranged in the multi-layered resin substrate 11 to encircle both the high-frequency-signal input part 12 and the high-frequency-signal output part 13 and connected to both the first and second metal layers 15 and 16. The high frequency signal is propagated between the high-frequency-signal input part 12 and the high-frequency-signal output part 13 through the multi-layered resin substrate 11, and even when the distance between the high-frequency-signal input part 12 and the high-frequency-signal output part 13 is increased, the propagation loss of the high frequency signal can be reduced effectively.

The portion of the multi-layered resin substrate 11 where the high frequency signal is propagated is surrounded by the first metal layer 15, the second metal layer 16, and the plurality of penetration vias 18. Hence, it is possible to prevent the leaking out of the high frequency signal being propagated between the high-frequency-signal input part 12 and the high-frequency-signal output parts 13 to the outside of the high-frequency line structure 10. At the same time, it is possible to block off the incoming electromagnetic waves from the outside of the high-frequency line structure 10 to the multi-layered resin substrate 11. Therefore, it is possible to reduce the propagation loss of the high frequency signal effectively.

The high-frequency line structure 10 of this embodiment is able to transmit a high frequency signal with a frequency of 30 GHz or greater along a transmission distance of 10 mm or greater with almost no propagation loss.

In the above-described embodiment, the single-stage penetration via 18 is electrically connected to both the first metal layer 15 and the second metal layer 16. Alternatively, a plurality of stages of vias and pads (not illustrated) instead of the single-stage penetration via 18 may be laminated in the thickness direction of the multi-layered resin substrate 11, in order to electrically connect the first metal layer 15 and the second metal layer 16 by the plurality of stages of vias and pads. The high-frequency line structure of such alternative embodiment can also provide advantageous effects that are the same as those of the high-frequency line structure 10 of the above-described embodiment.

Next, FIGS. 5 to 19 are diagrams for explaining a manufacturing process of a high-frequency line structure on a resin substrate of an embodiment of the invention. In FIGS. 5 to 19, the elements which are the same as corresponding elements of the high-frequency line structure 10 in FIGS. 2 to 4 are designated by the same reference numerals, and a description thereof will be omitted.

With reference to FIGS. 5 to 19, the manufacturing method of the high-frequency line structure 10 of this embodiment will be described.

Figure 5:
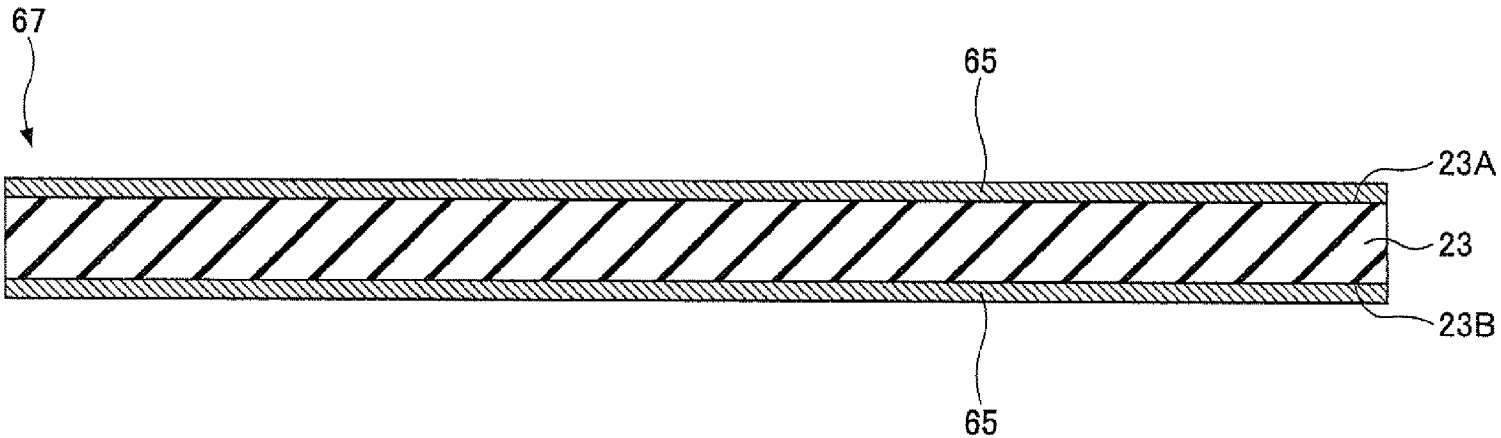
FIG. 5 is a diagram for explaining a manufacturing process of a high-frequency line structure on a resin substrate of an embodiment of the invention.

At the step illustrated in FIG. 5, metal layers 65 are respectively attached to top and bottom surfaces 23A and 23B of an insulating layer 23 which is set in a semi-cured state, so that a three-layer piece 67 (including the insulating layer 23 and the metal layers 65) is formed.

For example, an organic resin layer may be used as the insulating layer 23 which is set in the semi-cured state. In this case, a prepreg resin in which a resin (for example, epoxy resin) is impregnated in a glass cloth may be used as the insulating layer 23.

For example, a metallic foil (for example, cupper foil) may be used as the metal layer 65. In this case, the metal layer 65 may have a thickness of 20 micrometers, for example.

Subsequently, at the step illustrated in FIG. 6, the metal layer 65 (FIG. 5) disposed on the top surface 23A of the insulating layer 23 is patterned to form a first conductor 29 and a second conductor 48, and the metal layer 65 (FIG. 5) disposed on the bottom surface 23B of the insulating layer 23 is patterned to form a second pad 28 and a fourth pad 47. At this time, the second pad 28 is formed to face the first conductor 29, and the fourth pad 47 is formed to face the second conductor 48.

Specifically, the formation of the conductors 29 and 48 is carried out as follows. For example, a resist film (not illustrated) is formed on the top surface of the metal layer 65 disposed on the surface 23A of the insulating layer 23, to cover the formation areas of the conductors 29 and 48. Subsequently, the portion of the metal layer 65 exposed from the resist film is removed by etching, and thereafter the resist film is removed so that the conductors 29 and 48 are formed. The pads 28 and 47 may be formed in a manner that is the same as the formation of the conductors 29 and 48.

Subsequently, in preparation for the step illustrated in FIG. 7, a metal layer 59 is attached to a top surface 24A of an insulating layer 24 which is set in a semi-cured state, so that a two-layer piece 71 (including the metal layer 59 and the insulating layer 24) is formed.

Figure 6:
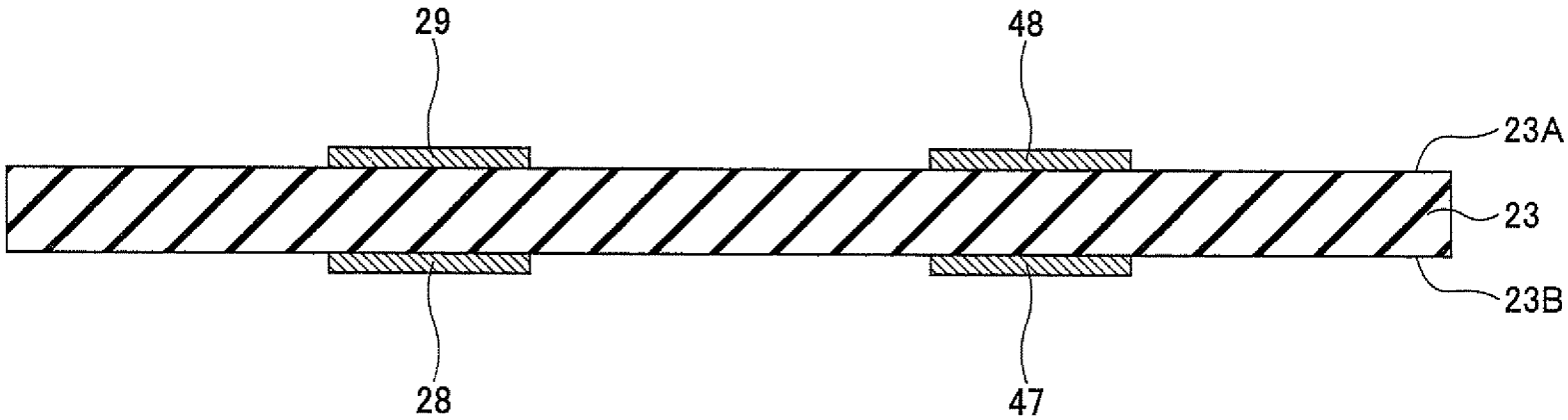
FIG. 6 is a diagram for explaining the manufacturing process of the high-frequency line structure of the present embodiment.
Figure 7:
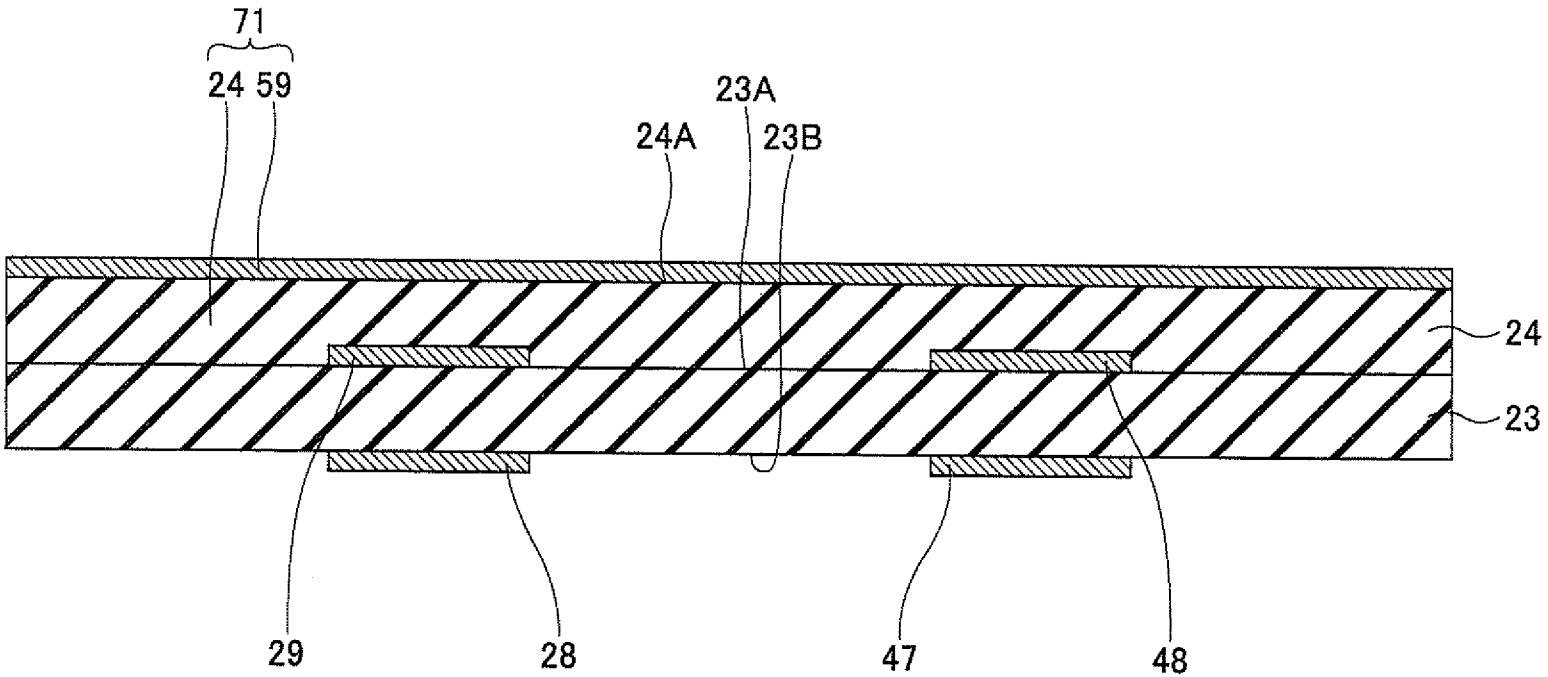
FIG. 7 is a diagram for explaining the manufacturing process of the high-frequency line structure of the present embodiment.

Next, the two-layer piece 71 is attached to the top surface 23A of the structure illustrated in FIG. 6 and the top surface 23A of the insulating layer 23 and the bottom surface of the semi-cured-state insulating layer 24 are in contact with each other, as illustrated in FIG. 7. After that, the insulating layer 24 is completely cured.

For example, an organic resin layer may be used as the insulating layer 24 which is set in the semi-cured state. In this case, a prepreg resin in which a resin (for example, epoxy resin) is impregnated in a glass cloth may be used as the insulating layer 24.

Figure 19:
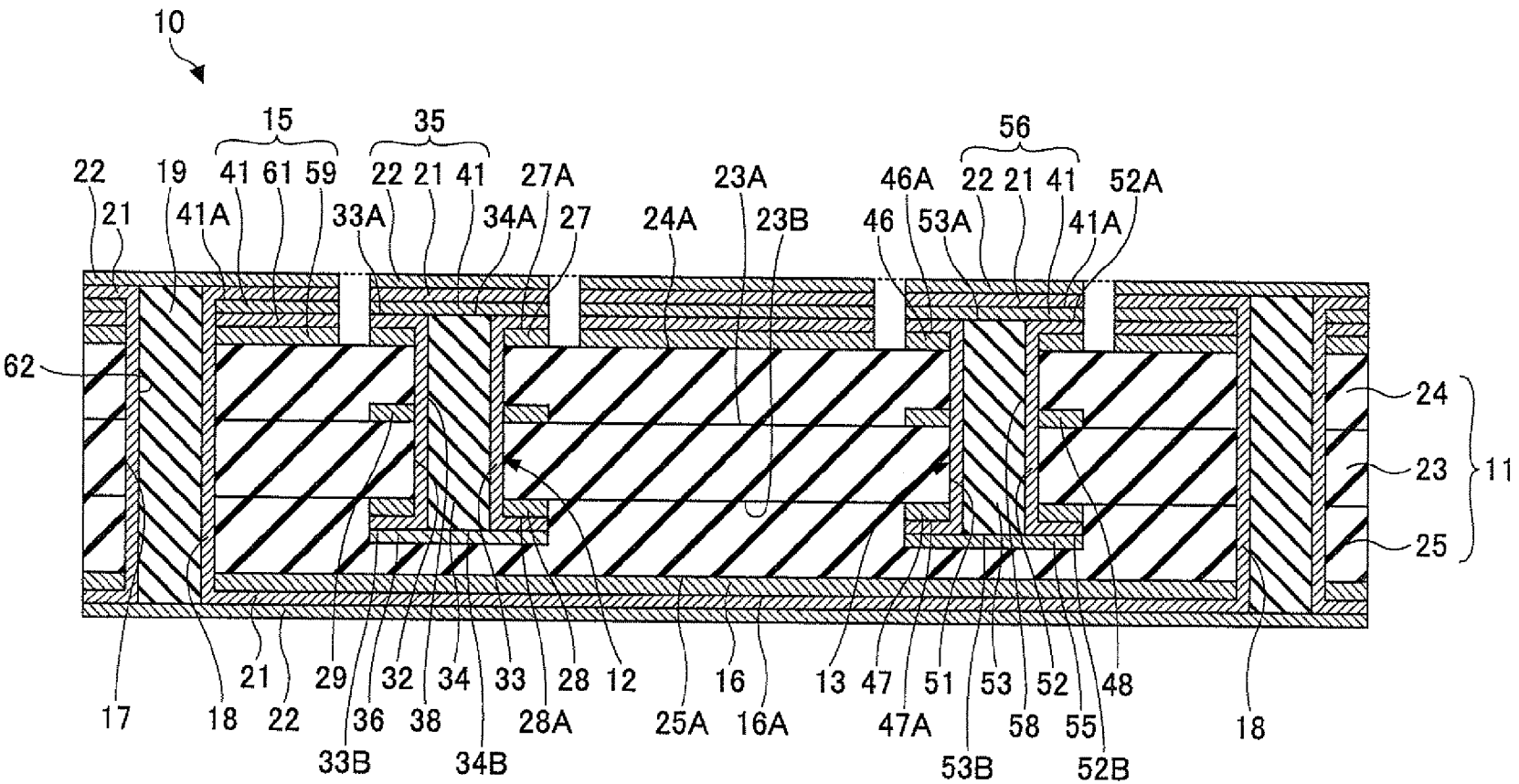
FIG. 19 is a diagram for explaining the manufacturing process of the high-frequency line structure of the present embodiment.

The metal layer 59 is a metal layer used as the pad 27 (the first pad) and the pad 46 (the third pad) as illustrated in FIG. 3 which will be formed by being patterned at the step illustrated in FIG. 19. For example, a metallic foil (for example, copper foil) may be used as the metal layer 59. In this case, the metal layer 59 may have a thickness of 20 micrometers, for example. The insulating layer 23 which is completely cured may have a thickness of 260 micrometers, for example. The insulating layer 24 which is completely cured may have a thickness of 300 micrometers, for example.

Figure 8:
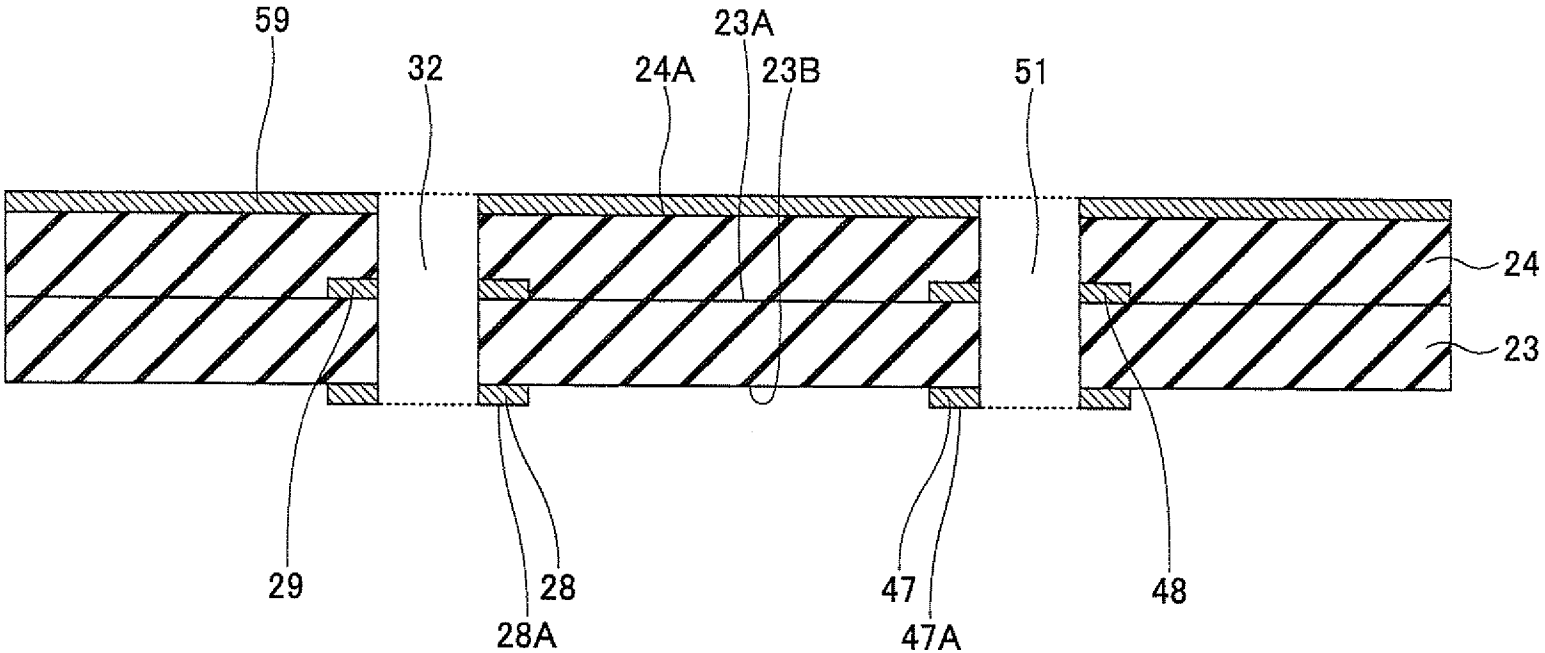
FIG. 8 is a diagram for explaining the manufacturing process of the high-frequency line structure of the present embodiment.

Subsequently, at the step illustrated in FIG. 8, the penetration hole 32 (the first penetration hole) which penetrates the metal layer 59, the pad 28, the conductor 29, and the completely cured insulating layers 23 and 24 is formed. Moreover, the penetration hole 51 (the second penetration hole) which penetrates the metal layer 59, the pad 47, the conductor 48, and the completely cured insulating layers 23 and 24 is formed. Thereby, on the side of the penetration hole 32, the portions of the pad 28 and the conductor 29 are exposed, and on the side of the penetration hole 51, the portions of the pad 47 and the conductor 48 are exposed.

Specifically, the penetration holes 32 and 51 may be formed by drilling the structure as illustrated in FIG. 7, for example. The penetration holes 32 and 51 may have a diameter of 250 micrometers, for example.

Figure 9:
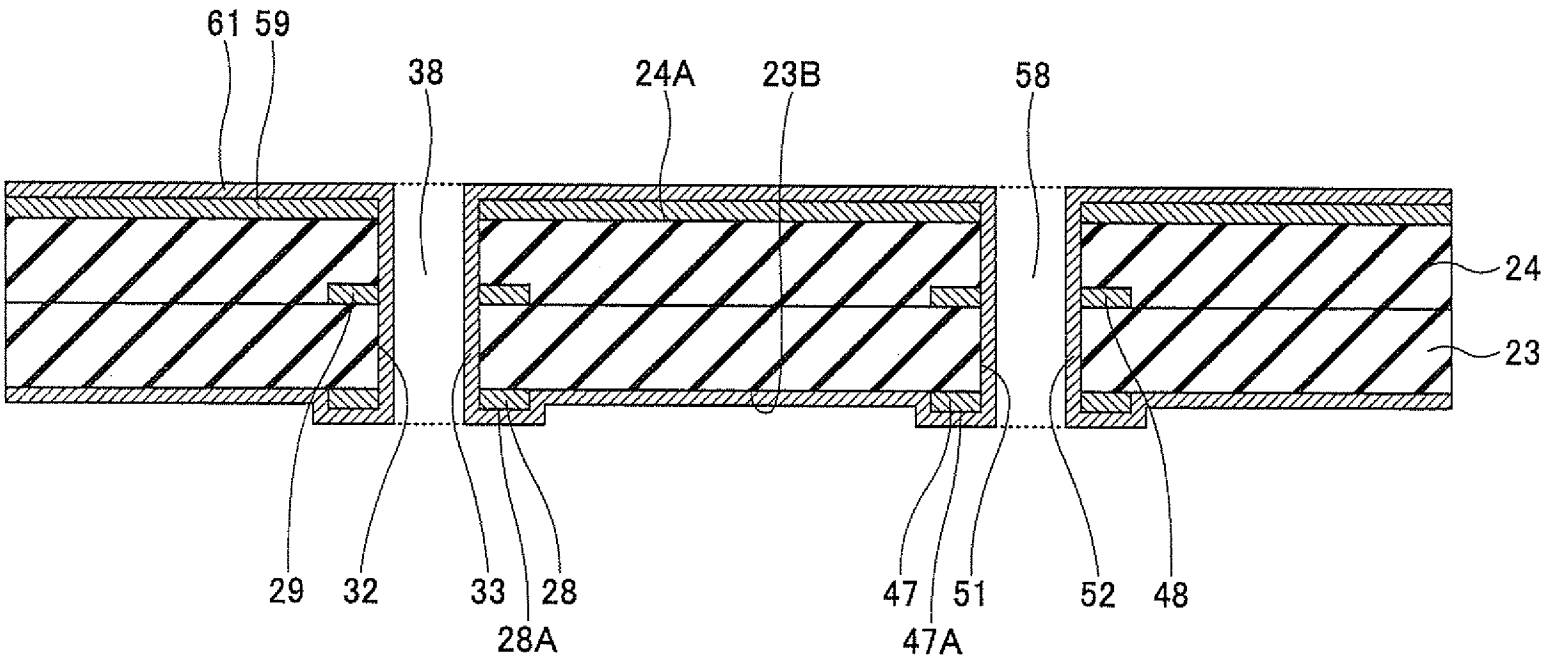
FIG. 9 is a diagram for explaining the manufacturing process of the high-frequency line structure of the present embodiment.

Subsequently, at the step illustrated in FIG. 9, a metal layer 61 is formed, and this metal layer 61 covers not only the top and bottom surfaces of the structure illustrated in FIG. 8 but also the sides of the penetration holes 32 and 51.

Specifically, the formation of the metal layer 61 is performed as follows. First, an electroless plating process is performed to form an electroless Cu plating layer (not illustrated) which covers both the top and bottom surfaces of the structure illustrated in FIG. 8 and the sides of the penetration holes 32 and 51. Next, using the electroless Cu plating layer as an electric supply layer, an electroplating process is performed to form an electrolysis Cu plating layer (not illustrated) on the electroless Cu plating layer so that the metal layer 61 in which the electroless Cu plating layer and the electrolysis Cu plating layer are laminated is formed.

Hence, the via 33 which is constituted by the metal layer 61 deposited on the penetration hole 32, and the via 52 which is constituted by the metal layer 61 deposited on the penetration hole 51 are formed simultaneously. In this stage, the via 33 and the via 52 are electrically connected to each other through the metal layer 61.

The via 33 which is formed on the side of the penetration hole 32 is connected to both the pad 28 and the conductor 29. The penetration hole 38 is formed to penetrate the centerline of the via 33. The via 52 which is formed on the side of the penetration hole 51 is connected to both the pad 47 and the conductor 48. The penetration hole 58 is formed to penetrate the centerline of the via 52.

As a material of the metal layer 61, for example, copper (Cu) may be used. In this case, the metal layer 61 may have a thickness of 15 micrometers, for example.

Subsequently, at the step illustrated in FIG. 10, an etching process is performed to remove the unnecessary portions of the metal layer 61 formed on the surface 23B of the insulating layer 23. In this stage, the via 33 and the via 52 are electrically connected to each other through the metal layer 59 formed on the surface 24A of the insulating layer 24 and through the metal layer 61 formed on the metal layer 59.

Subsequently, at the step illustrated in FIG. 11, the insulating resin 34 to fill up the penetration hole 38 and the insulating resin 53 fill up the penetration hole 58 are formed.

At this time, the insulating resins 34 and 53 are formed so that both the end faces 34A and 53A of the insulating resins 34 and 53 are flush with the top surface of the metal layer 61 respectively, and both the end faces 34B and 53B of the insulating resins 34 and 53 are flush with the end faces 33B and 52B of the vias 33 and 52 respectively. For example, a printing process may be performed to form the insulating resins 34 and 53. For example, an epoxy resin may be used as a material of the insulating resins 34 and 53.

Figure 11:
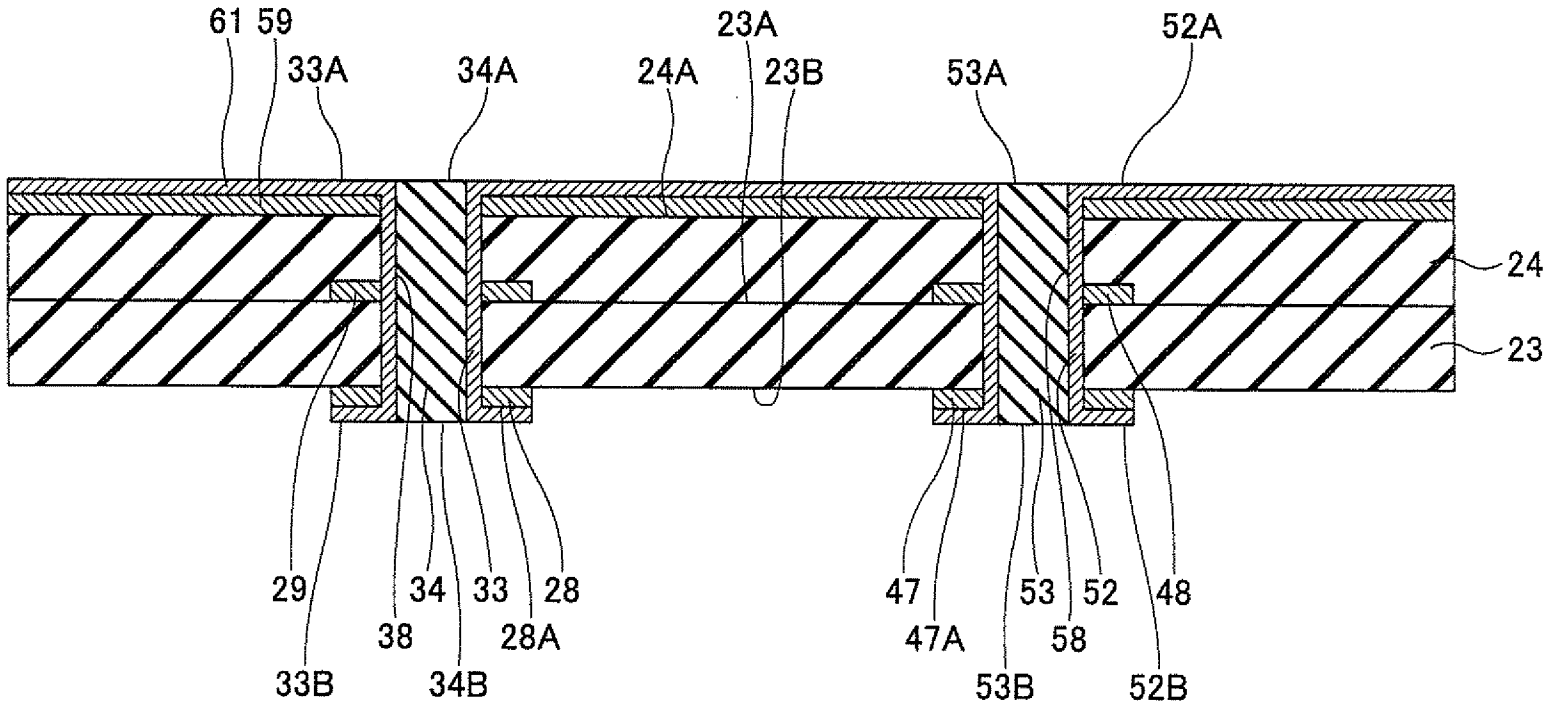
FIG. 11 is a diagram for explaining the manufacturing process of the high-frequency line structure of the present embodiment.

Subsequently, at the step illustrated in FIG. 12, the metal layer 41 which covers both the top and bottom surfaces of the structure illustrated in FIG. 11 is formed. Thereby, the first metal layer 15 in which the metal layer 59, the metal layer 61, and the metal layer 41 are laminated one by one on the surface 24A of the insulating layer 24 is formed. In this stage, the first metal layer 15 is electrically connected to the via 33 and the via 52.

For example, copper (Cu) may be used as a material of the metal layer 41. The metal layer 41 may have a thickness of 10 micrometers, for example.

Specifically, the formation of the metal layer 41 may be performed as follows. First, an electroless plating process is performed on both the surfaces of the structure illustrated in FIG. 11 to form an electroless Cu plating layer (not illustrated) which covers both the top and bottom surfaces of the structure illustrated in FIG. 11. Next, using the electroless Cu plating layer as an electric supply layer, an electroplating process is performed to form an electrolysis Cu plating layer (not illustrated) on the electroless Cu plating layer, so that the metal layer 41 in which the electroless Cu plating layer and the electrolysis Cu plating layer are laminated is formed.

Figure 12:
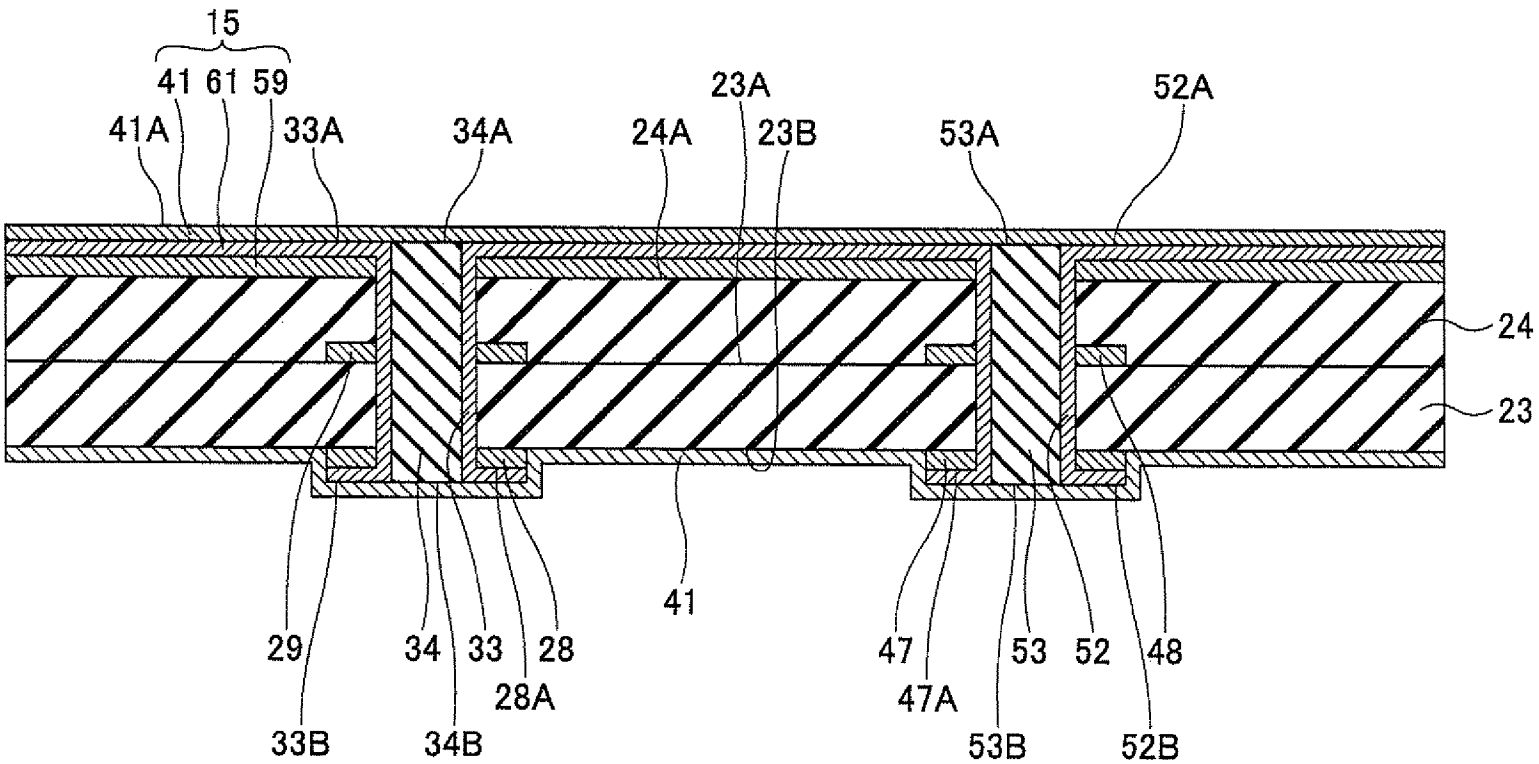
FIG. 12 is a diagram for explaining the manufacturing process of the high-frequency line structure of the present embodiment.
Figure 13:
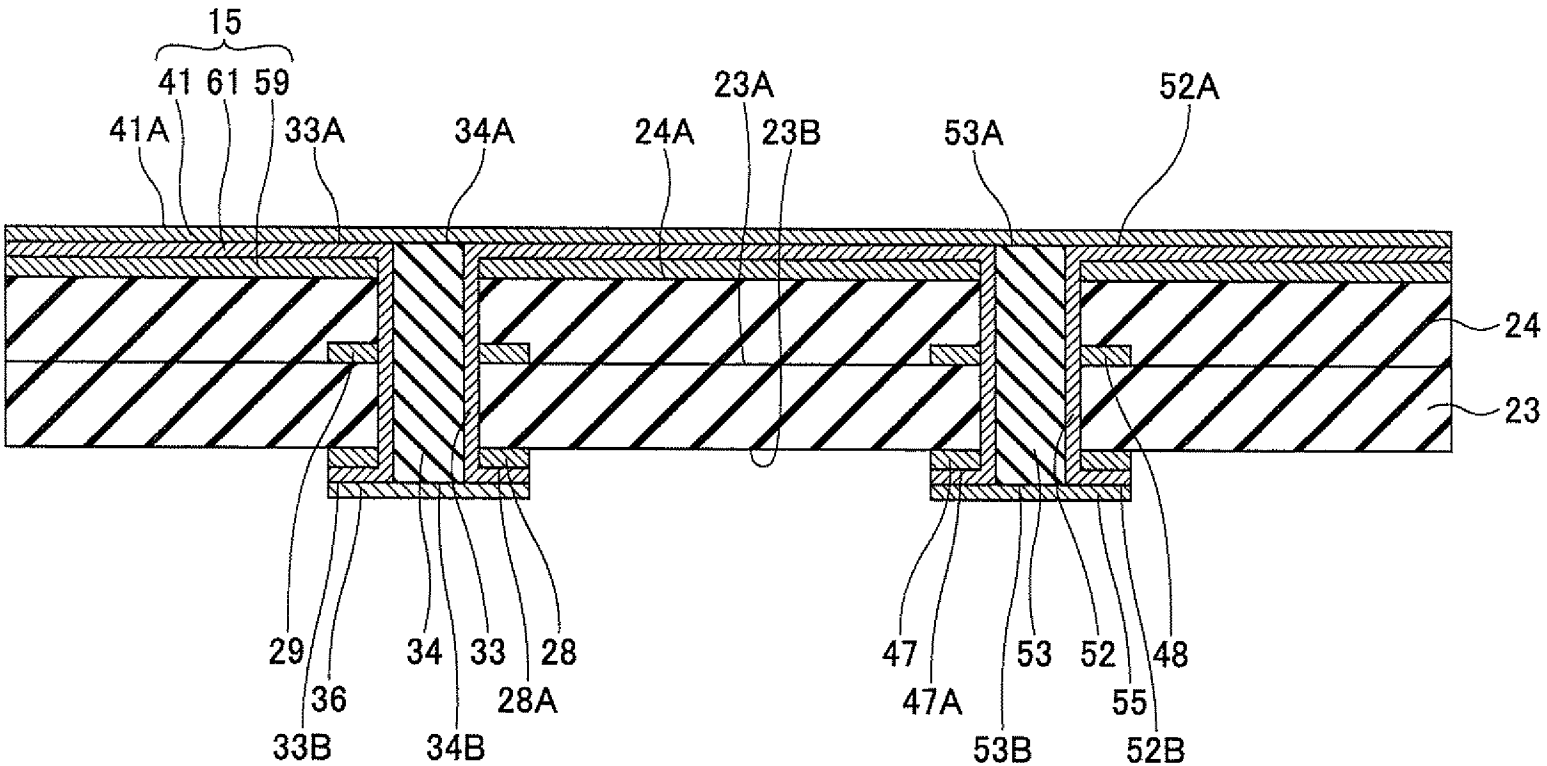
FIG. 13 is a diagram for explaining the manufacturing process of the high-frequency line structure of the present embodiment.

The metal layer 41 formed on the bottom surface of the structure illustrated in FIG. 12 will be turned into a base metal of the supply pad 36 (FIG. 13) and a base metal of the reception pad 55 (FIG. 13).

Figure 10:
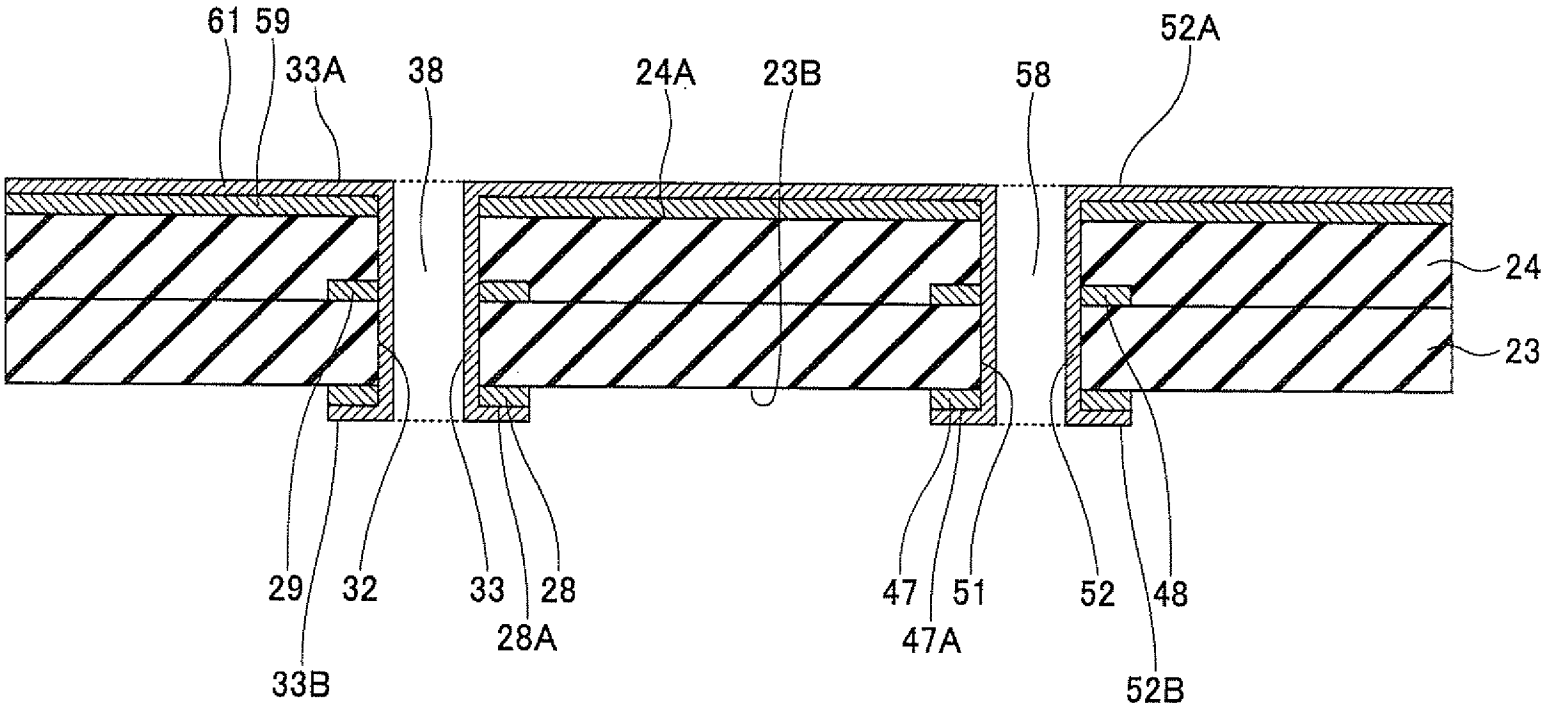
FIG. 10 is a diagram for explaining the manufacturing process of the high-frequency line structure of the present embodiment.

Subsequently, at the step illustrated in FIG. 13, an etching process which is the same as that performed at the step illustrated in FIG. 10 is performed to remove the unnecessary portions of the metal layer 41 formed on the surface 23B of the insulating layer 23. Thereby, the supply pad 36 which covers the end face 34B of the insulating resin 34 and the end face 33B of the via 33, and the reception pad 55 which covers the end face 53B of the insulating resin 53 and the end face 52B of the via 52 are formed simultaneously.

Figure 14:
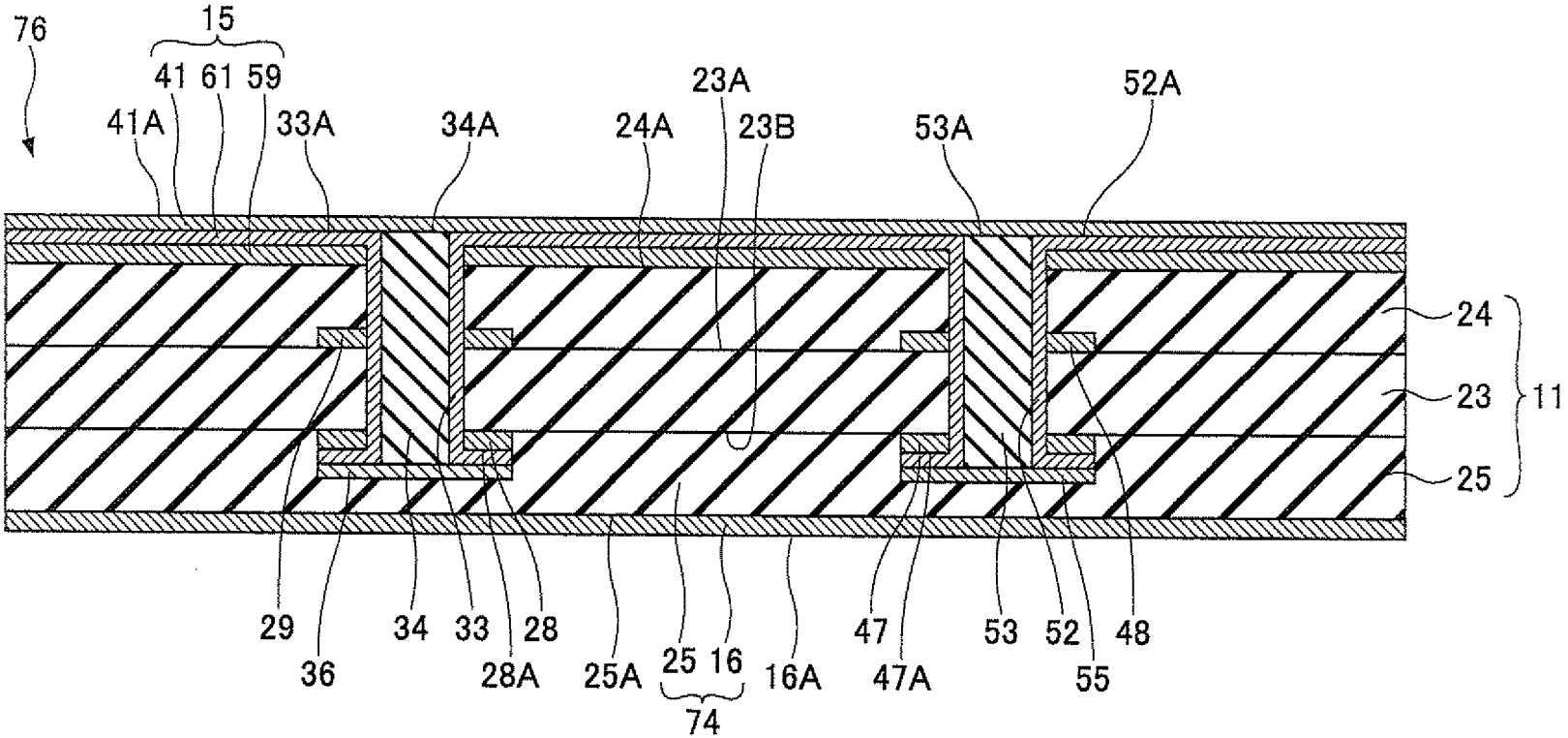
FIG. 14 is a diagram for explaining the manufacturing process of the high-frequency line structure of the present embodiment.

Subsequently, in preparation for the step illustrated in FIG. 14, a second metal layer 16 is attached to a bottom surface 25A of an insulating layer 25 which is set in a semi-cured state, so that a two-layer piece 74 (including the insulating layer 25 and the second metal layer 16) is formed. At the step illustrated in FIG. 14, the two-layer piece 74 is formed on the bottom surface of the structure illustrated in FIG. 13 and the bottom surface 23B of the insulating layer 23 and the top surface of the semi-cured-state insulating layer 25 are in contact with each other, and thereafter the insulating layer 25 is completely cured.

Hence, a multi-layered interconnection structure 76 which includes the multi-layered resin substrate 11 (which is constituted by the completely cured insulating layers 23-25), the pads 28 and 47, the conductors 29 and 48, the vias 33 and 52, the supply pad 36, the reception pad 55, the first metal layer 15, and the second metal layer 16 is formed. The manufacturing process illustrated in FIGS. 5 to 14 is equivalent to a multi-layered interconnection structure fabricating step.

For example, an organic resin layer may be used as the insulating layer 25 which is set in the semi-cured state. In this case, for example, a prepreg resin in which a resin (for example, epoxy resin) is impregnated in a glass cloth may be used as a material of the insulating layer 25. In this case, the completely cured insulating layer 25 may have a thickness of 300 micrometers, for example.

For example, a metallic foil (for example, copper foil) may be used as a material of the second metal layer 16. In this case, the second metal layer 16 may have a thickness of 20 micrometers, for example.

Figure 15:
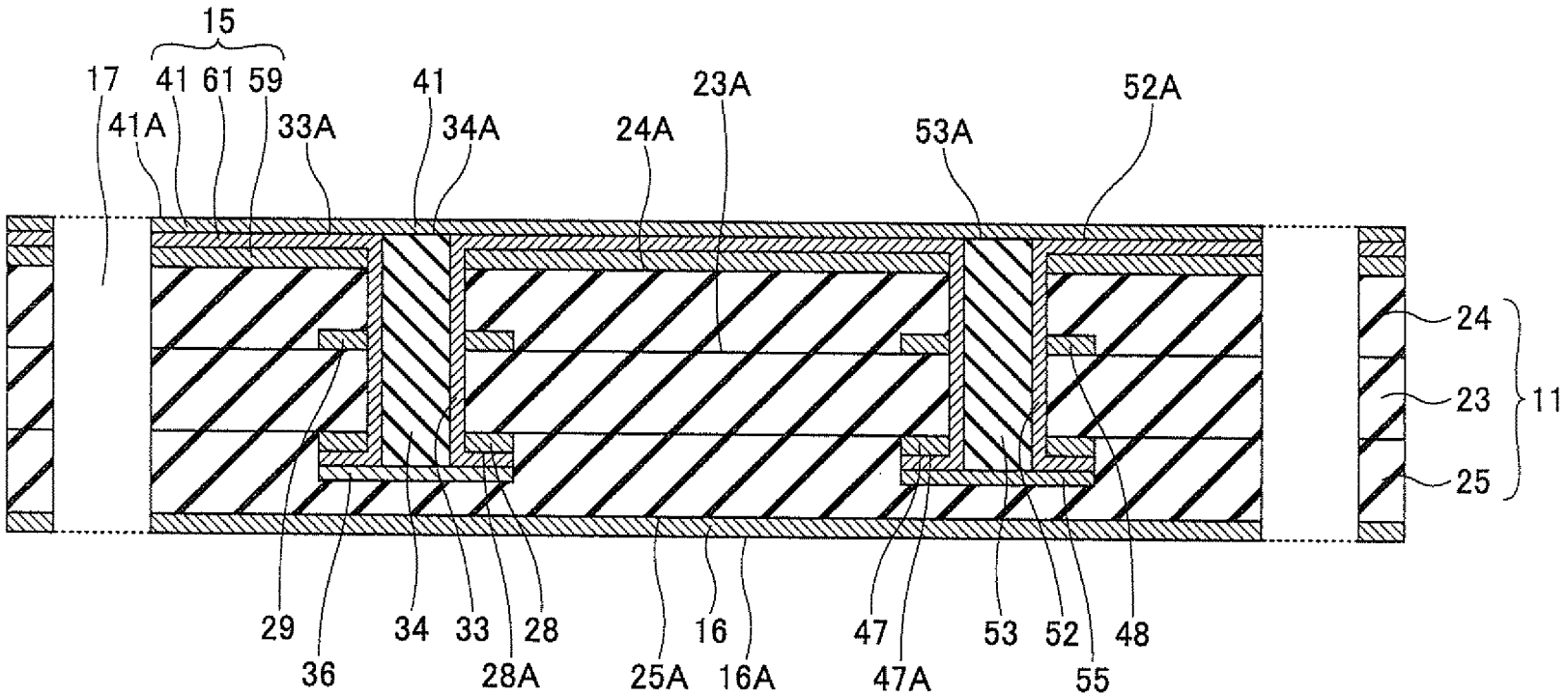
FIG. 15 is a diagram for explaining the manufacturing process of the high-frequency line structure of the present embodiment.

Subsequently, at the step illustrated in FIG. 15, the plurality of penetration holes 17 (third penetration holes) are formed to penetrate the first metal layer 15, the second metal layer 16, and the multi-layered resin substrate 11 in the portions located between the first metal layer 15 and the second metal layer 16, among the components of the multi-layered interconnection structure 76 illustrated in FIG. 14 (penetration hole forming step).

Specifically, the plurality of penetration holes 17 are formed by, for example, drilling the first metal layer 15, the second metal layer 16, and the multi-layered resin substrate 11 in the portions located between the first metal layer 15 and the second metal layer 16. At this time, the plurality of penetration holes 17 are formed to encircle both the area where the high-frequency-signal input part 12 is formed and the area where the high-frequency-signal output part 13 is formed. Each penetration hole 17 may have a diameter of 350 micrometers, for example.

Figure 16:
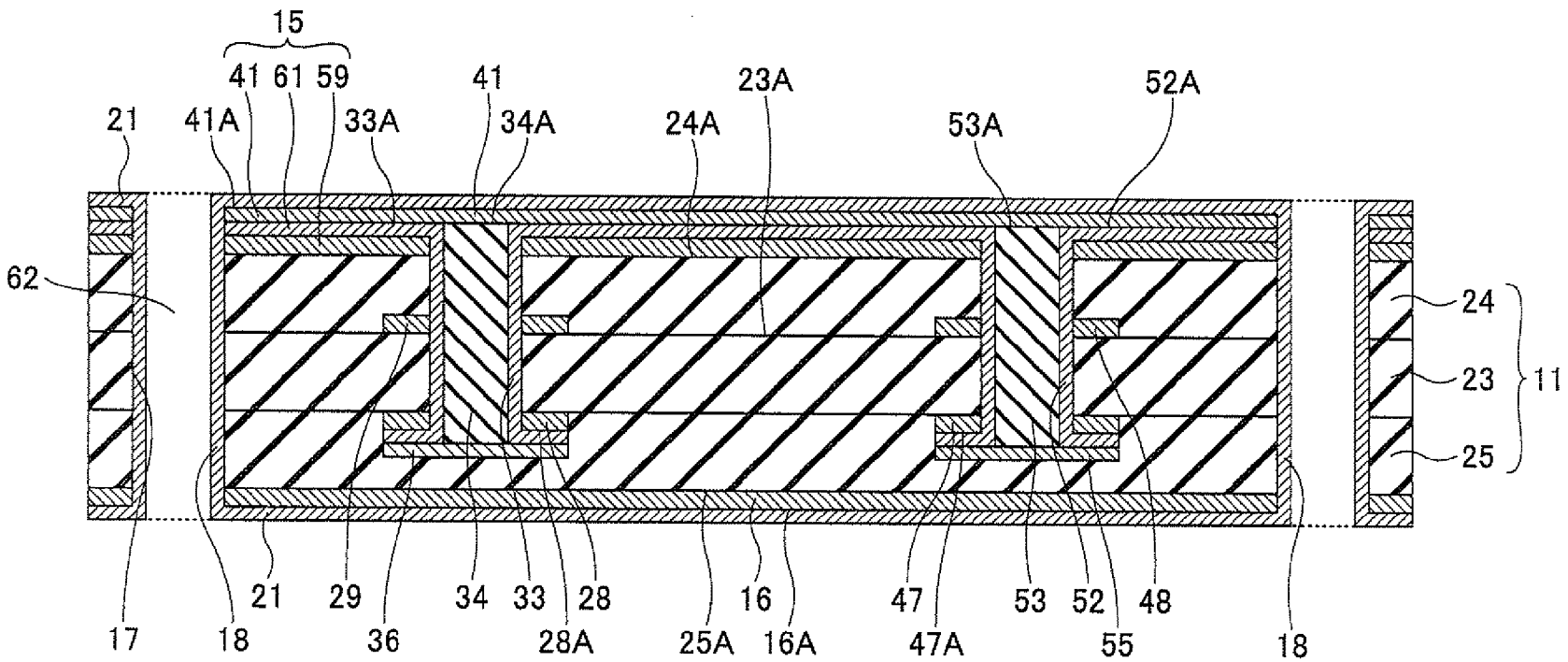
FIG. 16 is a diagram for explaining the manufacturing process of the high-frequency line structure of the present embodiment.

Subsequently, at the step illustrated in FIG. 16, the plating process (which is the same as that performed at the step illustrated in FIG. 9) is performed to form the metal layer 21 which covers both the top and bottom surfaces of the structure illustrated in FIG. 15 and the side of each of the plurality of penetration holes 17. Hence, the penetration via 18 which uses the metal layer 21 as the base metal is formed on the side of each of the plurality of penetration holes 17. In this stage, the plurality of penetration vias 18 are electrically connected to the via 33 and the via 52.

As described above, the multi-layered interconnection structure 76 (FIG. 14) including the multi-layered resin substrate 11, the second and fourth pads 28 and 47, the first and second conductors 29 and 48, the first and second vias 33 and 52, the supply pad 36, the reception pad 55, the first metal layer 15, and the second metal layer 16 is formed, and subsequently, the plurality of penetration holes 17 which penetrate the first metal layer 15, the second metal layer 16, and the portions of the multi-layered resin substrate 11 located between the first metal layer 15 and the second metal layer 16 are formed. Thereafter, the penetration via 18 which is connected to the first and second metal layers 15 and 16 is formed on each of the plurality of penetration holes 17 by plating. When compared with the case in which the first metal layer 15 and the second metal layer 16 are electrically connected together through a plurality of vias and a plurality of wiring lines (not illustrated), the manufacturing cost of the high-frequency line structure 10 can be reduced.

Subsequently, at the step illustrated in FIG. 17, the insulating resin 19 to fill up the penetration hole 62 is formed by performing the process which is the same as that performed at the step illustrated in FIG. 11. At this time, the insulating resin 19 is formed so that the end face 19A of the insulating resin 19 is flush with the top surface of the metal layer 21 formed on the first metal layer 15, and the end face 19B of the insulating resin 19 is flush with the bottom surface of the metal layer 21 formed on the second metal layer 16.

Figure 17:
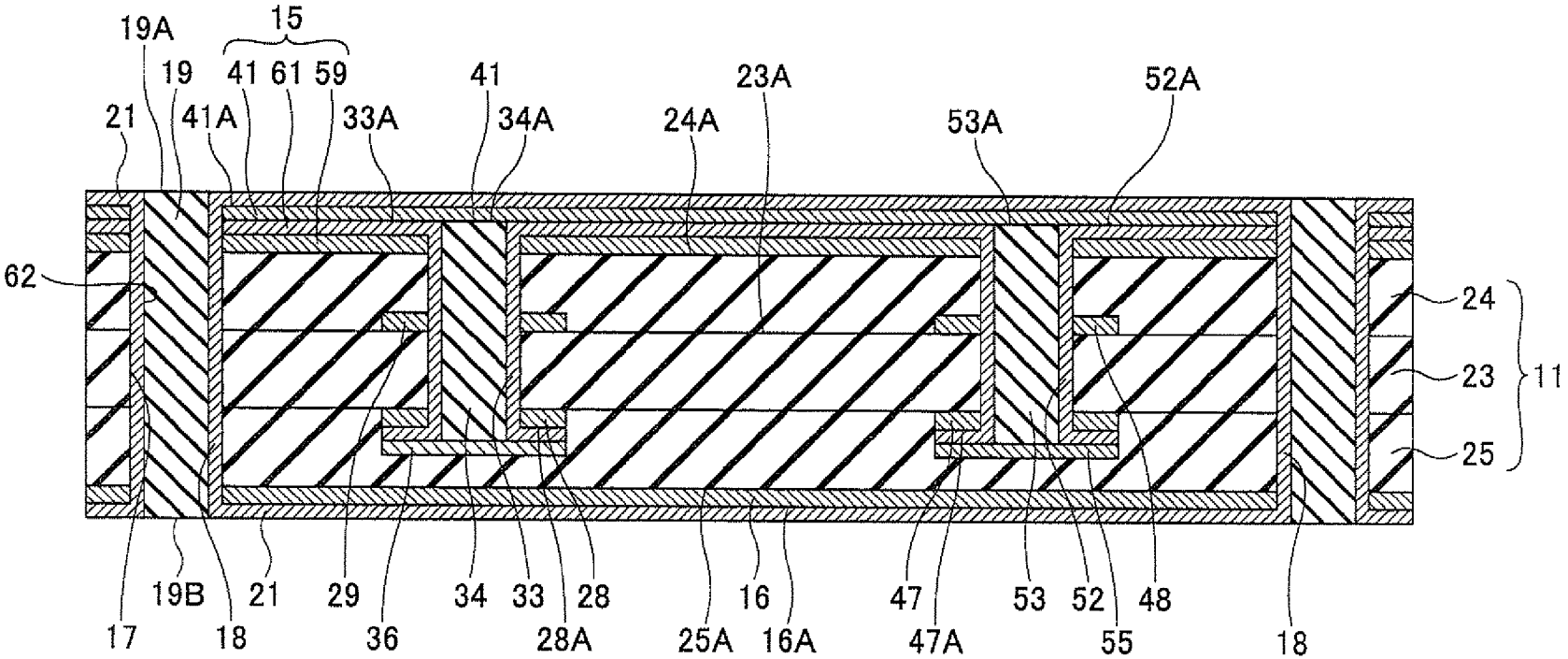
FIG. 17 is a diagram for explaining the manufacturing process of the high-frequency line structure of the present embodiment.

Subsequently, at the step illustrated in FIG. 18, the metal layer 22 which covers both the top and bottom surfaces of the structure illustrated in FIG. 17 is formed by performing the process which is the same as that performed at the step illustrated in FIG. 12. Thereby, the insulating resin 19 is sealed within the penetration hole 62 (FIG. 17).

Figure 18:
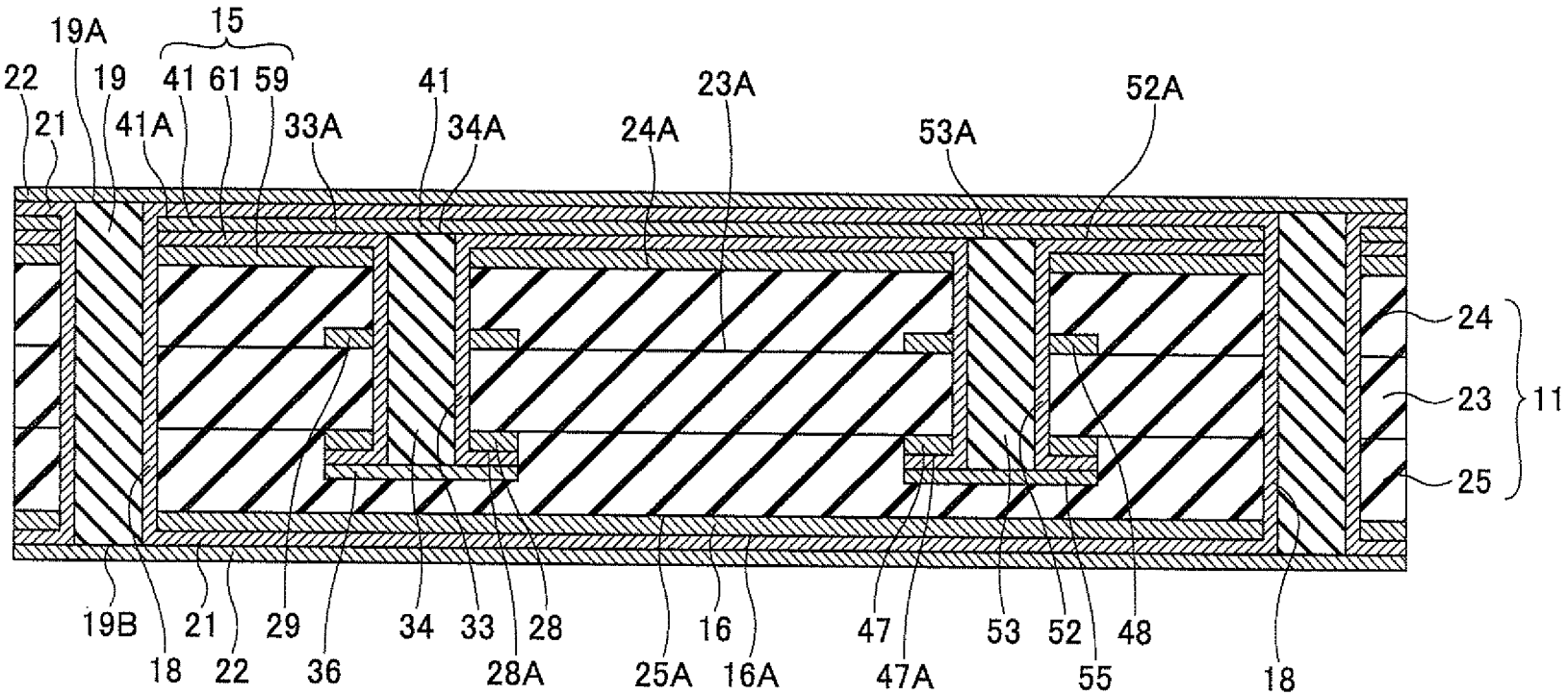
FIG. 18 is a diagram for explaining the manufacturing process of the high-frequency line structure of the present embodiment.

Subsequently, at the step illustrated in FIG. 19, an etching process is performed so that the metal layers 59, 61, 41, 21 and 22 laminated on the top surface of the structure illustrated in FIG. 18 are patterned. Thereby, the input pad 35, the output pad 56, and the first metal layer 15 electrically insulated from the input pad 35 and the output pad 56 are formed simultaneously. Accordingly, the high-frequency line structure 10 of this embodiment is manufactured.

In the high-frequency line structure manufacturing method of the above-described embodiment, the high frequency signal input part 12 is formed on the multi-layered resin substrate 11 in which the insulating layers 23-25 are laminated, and arranged to supply the input high frequency signal to the multi-layered resin substrate 11. The high-frequency-signal output part 13 is formed on the multi-layered resin substrate 11 in the position apart from the high frequency signal input part 12 and arranged to receive the high frequency signal from the high frequency signal input part 12 through the multi-layered resin substrate 11 and output the received high frequency signal. The first metal layer 15 is formed on the top surface of the multi-layered resin substrate 11 and electrically insulated from the high-frequency-signal input part 12 and the high-frequency-signal output part 13. The second metal layer 16 is formed to cover the bottom surface of the multi-layered resin substrate 11. The plurality of penetration vias 18 are arranged in the multi-layered resin substrate 11 to encircle the high-frequency-signal input part 12 and the high-frequency-signal output part 13, and connected to the first and second metal layers 15 and 16. Thus, it is possible to manufacture the high-frequency line structure 10 which is able to reduce the propagation loss of the high frequency signal between the high-frequency-signal input part 12 and the high-frequency-signal output part 13.

Furthermore, in the high-frequency line structure manufacturing method of the above-described embodiment, the plurality of penetration holes 17 which penetrate the first metal layer 15, the second metal layer 16, and the portions of the multi-layered resin substrate 11 located between the first metal layer 15 and the second metal layer 16 are formed. Thereafter, the penetration via 18 which is electrically connected to the first and second metal layers 15 and 16 is formed on each of the plurality of penetration holes 17 by plating. As compared with the case in which the first metal layer 15 and the second metal layer 16 are electrically connected together through a plurality of vias and wiring lines (not illustrated), the manufacturing cost of the high-frequency line structure 10 can be reduced.

Figure 20:
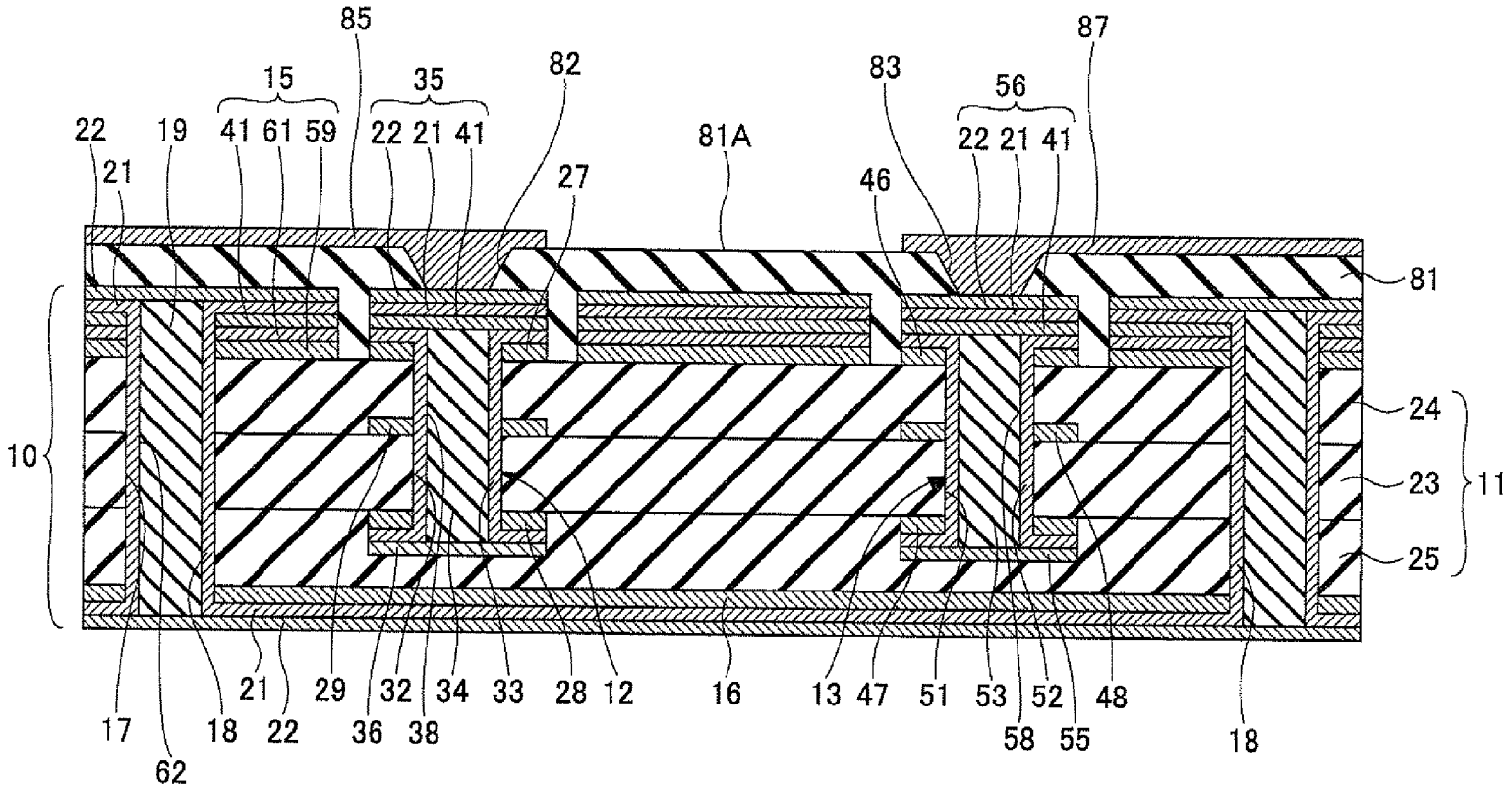
FIG. 20 is a diagram illustrating the composition of a microstrip line device to which a high-frequency line structure of an embodiment of the invention is applied.

FIG. 20 is a diagram illustrating the composition of a microstrip line device to which a high-frequency line structure of an embodiment of the invention is applied. In FIG. 20, the elements which are the same as corresponding elements in the high-frequency line structure 10 of this embodiment are designated by the same reference numerals, and a description thereof will be omitted.

When the high-frequency line structure 10 is used practically, for example, an MSL (microstrip line) is formed on the top surface of the high-frequency line structure 10 as illustrated in FIG. 20. The MSL comprises; an insulating layer 81 (which is made of, for example, an insulating resin, such as polyimide) including an opening 82 in which the top surface of the input pad 35 is exposed and an opening 83 in which the top surface of the output pad 56 is exposed; a first wiring pattern 85 disposed on the opening 82 and the top surface 81A of the insulating layer 81 and connected to the input pad 35; and a second wiring pattern 87 disposed on the opening 83 and the top surface 81A of the insulating layer 81 and connected to the output pad 56. In this case, the Zo matching circuit is provided to match the impedance of the MSL and the waveguide.

In the above-described microstrip line device, a high frequency signal of the TEM mode (in which the signal of Transverse Electro-Magnetic waves is propagated) propagated by the first wiring pattern 85 is input to the input pad 35, and then the signal of the TE mode (in which the signal of Transverse Electric waves is propagated) and the signal of the TM mode (in which the signal of Transverse Magnetic waves is propagated) are propagated in the waveguide. Subsequently, the high frequency signal of the TEM mode is output from the output pad 56 and propagated to the second wiring pattern 87.

There may be another composition in which the high-frequency line structure 10 is used. For example, a wiring substrate (not illustrated) in which the MSL (microstrip line) is formed may be implemented on the input pad 35 and the output pad 56 of the high-frequency line structure 10. In this case, the Zo matching circuit is provided to match the impedance of the MSL which is formed in the wiring substrate and the waveguide.

According to the present disclosure, the propagation loss of a high frequency signal which is propagated on the high-frequency line structure can be effectively reduced.

The present disclosure is not limited to the above-described embodiments, and variations and modifications may be made without departing from the scope of the invention.

What is claimed is:

1. A high-frequency line structure, comprising:

a multi-layered resin substrate in which a plurality of insulating layers of a resin are laminated;

a high-frequency-signal input part including an input pad over a first surface of the resin substrate, a supply pad in the resin substrate to face the input pad, and a first via in a portion of the resin substrate located between the input pad and the supply pad and connected to the input pad and the supply pad;

a high-frequency-signal output part including an output pad over the first surface of the resin substrate, a reception pad in the resin substrate to face the output pad, and a second via in a portion of the resin substrate located between the output pad and the reception pad, the second via being connected to the output pad and the reception pad;

a first metal layer on the first surface of the resin substrate to encircle the input pad and the output pad, the first metal layer electrically insulated from the high-frequency-signal input part and the high-frequency-signal output part;

a second metal layer on a second surface of the resin substrate opposite to the first surface of the resin substrate; and a plurality of penetration vias arranged to penetrate the resin substrate and encircle the high-frequency-signal input part and the high-frequency-signal output part, and each penetration via connected to the first and second metal layers, wherein a microstrip line is formed on a top surface of the high-frequency line structure, the microstrip line comprising an insulation layer to cover the top surface of the high-frequency line structure, a first wiring pattern formed on the insulation layer and connected to the input pad, and a second wiring pattern formed on the insulation layer and connected to the output pad;

the high-frequency-signal input part further includes:

a first pad arranged on the first surface of the resin substrate and under the input pad and connected to one end of the first via;

a second pad arranged in the resin substrate and over the supply pad to face the first pad, and connected to the other end of the first via; and a first conductor arranged in a portion of the resin substrate between the first pad and the second pad to face the first and second pads, connected to the first via, and provided for impedance matching; and the high-frequency-signal output part further includes:

a third pad arranged on the first surface of the resin substrate and under the output pad and connected to one end of the second via;

a fourth pad arranged in the resin substrate and over the reception pad to face the third pad, and connected to the other end of the second via; and a second conductor arranged in a portion of the resin substrate between the third pad and the fourth pad to face the third and fourth pads, connected to the second via, and provided for impedance matching.

2. The high-frequency line structure according to claim 1, wherein the high-frequency line structure includes a waveguide surrounded by the first metal layer, the second metal layer, and the plurality of penetration vias.

3. The high-frequency line structure according to claim 1, further comprising:

a first penetration hole in which the first via is formed, the first penetration hole penetrating the first pad, the first conductor, the second pad, and the portion of the resin substrate between the first pad and the second pad;

a second penetration hole in which the second via is formed, the second penetration hole penetrating the third pad, the second conductor, the fourth pad, and the portion of the resin substrate between the third pad and the fourth pad; and a plurality of third penetration holes in which the plurality of penetration vias are formed respectively, the plurality of third penetration holes arranged to penetrate the first metal layer, the resin substrate, and the second metal layer and encircle the high-frequency-signal input part and the high-frequency-signal output part.

4. A method of manufacturing a high-frequency line structure, comprising:

forming a multi-layered interconnection structure including: a multi-layered resin substrate in which a plurality of insulating layers of a resin are laminated; a high-frequency-signal input part including an input pad over a first surface of the resin substrate, a supply pad in the resin substrate facing the input pad, and a first via in a portion of the resin substrate located between the input pad and the supply pad and connected to the input pad and the supply pad; a high-frequency-signal output part including an output pad over the first surface of the resin substrate, a reception pad in the resin substrate facing the output pad, and a second via in a portion of the resin substrate located between the output pad and the reception pad, the second via being connected to the output pad and the reception pad; a first metal layer on the first surface of the resin substrate encircling the input pad and the output pad, the first metal layer electrically insulated from the high-frequency-signal input part and the high-frequency-signal output part; and a second metal layer on a second surface of the resin substrate opposite to the first surface of the resin substrate;

forming a plurality of penetration vias which penetrate the first metal layer, the second metal layer, and the portion of the multi-layered resin substrate between the first metal layer and the second metal layer, after the multi-layered interconnection structure is formed; and forming a microstrip line on a top surface of the high-frequency line structure, the microstrip line comprising an insulation layer covering the top surface of the high-frequency line structure, a first wiring pattern formed on the insulation layer and connected to the input pad, and a second wiring pattern formed on the insulation layer and connected to the output pad;

wherein the forming of the multi-layered interconnection structure includes:

forming the high-frequency-signal input part further including:

a first pad arranged on the first surface of the resin substrate and under the input pad and connected to one end of the first via;

a second pad arranged in the resin substrate and over the supply pad to face the first pad, and connected to the other end of the first via; and a first conductor arranged in a portion of the resin substrate between the first pad and the second pad to face the first and second pads, connected to the first via, and provided for impedance matching; and forming the high-frequency-signal output part further including:

a third pad arranged on the first surface of the resin substrate and under the output pad and connected to one end of the second via;

a fourth pad arranged in the resin substrate and over the reception pad to face the third pad, and connected to the other end of the second via; and a second conductor arranged in a portion of the resin substrate between the third pad and the fourth pad to face the third and fourth pads, connected to the second via, and provided for impedance matching.

5. The method of claim 4, wherein the forming of the plurality of penetration vias includes:

forming a plurality of penetration holes which penetrate the first metal layer, the second metal layer, and the portion of the resin substrate between the first metal layer and the second metal layer; and forming the plurality of penetration vias on the plurality of penetration holes respectively by plating.

6. The method of claim 5, wherein the forming of the plurality of penetration vias includes forming a plurality of third penetration holes by drilling of the first metal layer, the second metal layer, and the multi-layered resin substrate.

* * * * *